US011401481B2

(12) United States Patent
Oki

(10) Patent No.: US 11,401,481 B2
(45) Date of Patent: Aug. 2, 2022

(54) LUBRICANT COMPOSITION AND METHOD FOR PRODUCING SAME

(71) Applicant: IDEMITSU KOSAN CO., LTD., Chiyoda-ku (JP)

(72) Inventor: Hiroshi Oki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/284,602

(22) PCT Filed: Oct. 18, 2019

(86) PCT No.: PCT/JP2019/041046
§ 371 (c)(1),
(2) Date: Apr. 12, 2021

(87) PCT Pub. No.: WO2020/085228
PCT Pub. Date: Apr. 30, 2020

(65) Prior Publication Data

US 2021/0253970 A1 Aug. 19, 2021

(30) Foreign Application Priority Data

Oct. 22, 2018 (JP) ..... JP2018-198755

(51) Int. Cl.

| | |
|---|---|
| ***C10M 125/22*** | (2006.01) |
| ***C10M 129/10*** | (2006.01) |
| ***C10M 129/50*** | (2006.01) |
| ***C10M 129/54*** | (2006.01) |
| ***C10M 133/08*** | (2006.01) |
| ***C10M 133/40*** | (2006.01) |
| ***C10M 169/04*** | (2006.01) |
| *C10N 40/25* | (2006.01) |
| *C10N 30/00* | (2006.01) |
| *C10N 10/04* | (2006.01) |
| *C10N 30/04* | (2006.01) |

(52) U.S. Cl.
CPC ..... *C10M 125/22* (2013.01); *C10M 129/10* (2013.01); *C10M 129/50* (2013.01); *C10M 129/54* (2013.01); *C10M 133/08* (2013.01); *C10M 133/40* (2013.01); *C10M 169/04* (2013.01); *C10M 2201/084* (2013.01); *C10M 2207/028* (2013.01); *C10M 2207/141* (2013.01); *C10M 2207/144* (2013.01); *C10M 2215/042* (2013.01); *C10M 2215/221* (2013.01); *C10N 2010/04* (2013.01); *C10N 2030/04* (2013.01); *C10N 2030/45* (2020.05); *C10N 2040/252* (2020.05); *C10N 2040/255* (2020.05)

(58) Field of Classification Search
CPC ..... C10M 133/08; C10M 133/40; C10M 135/10; C10M 159/22; C10N 2030/45; C10N 2040/25; C10N 2010/04; C10N 2030/52
See application file for complete search history.

(56) References Cited

U.S. PATENT DOCUMENTS

| | | | | |
|---|---|---|---|---|
| 2013/0244918 | A1 | 9/2013 | Barton et al. | |
| 2017/0009179 | A1* | 1/2017 | Gao | C10M 169/04 |
| 2017/0211011 | A1* | 7/2017 | Carabell | C10M 145/04 |
| 2019/0024009 | A1 | 1/2019 | Kusumoto et al. | |

FOREIGN PATENT DOCUMENTS

| | | | |
|---|---|---|---|
| CN | 103249757 | A | 8/2013 |
| CN | 108291171 | A | 7/2018 |
| JP | 5-105893 | A | 4/1993 |
| JP | 2000-63869 | A | 2/2000 |
| JP | 2000-256690 | A | 9/2000 |
| JP | 2017-149830 | A | 8/2017 |
| WO | 2017/146232 | A1 | 8/2017 |
| WO | WO 2018/043495 | A1 | 3/2018 |

OTHER PUBLICATIONS

International Search Report dated Dec. 10, 2019 in PCT/JP2019/041046 filed Oct. 18, 2019, 2 pages.
Office Action dated Mar. 11, 2022, in Chinese Patent Application No. 201980068968.9 filed Oct. 18, 2019.
Extended European Search Report issued in EPC Application No. 19876527.3, dated Jun. 20, 2022.

* cited by examiner

*Primary Examiner* — Vishal V Vasisth
(74) *Attorney, Agent, or Firm* — Oblon, McClelland, Maier & Neustadt, L.L.P.

(57) ABSTRACT

The present invention relates to a lubricant composition containing: a base oil (A); at least one kind of calcium-based detergent (B) selected from (B1) calcium sulfonate having a base number of 5.00 mgKOH/g or more and 100 mgKOH/g or less, (B2) calcium salicylate having a branched acyclic hydrocarbon group, and (B3) overbased calcium phenate having a branched acyclic hydrocarbon group; and at least one kind of ashless detergent (C) selected from (C1) a hindered amine compound having one piperidine-derived backbone in a molecule, and (C2) a specific diethanolamine compound. In the lubricant composition, the calcium atom content is 100 ppm by mass or more and 600 ppm by mass or less with respect to the total mass of the lubricant composition, and the ratio ($N_C/Ca_B$) of the nitrogen atom content ($N_C$) of the ashless detergent (C) to the calcium atom content ($Ca_B$) of the calcium-based detergent (B) is 1.3 to 3.1 as a mass ratio.

18 Claims, No Drawings

LUBRICANT COMPOSITION AND METHOD FOR PRODUCING SAME

This application is a 371 of PCT/JP2019/041046 filed Oct. 18, 2019.

TECHNICAL FIELD

The present invention relates to a lubricant composition and a method for producing the same.

BACKGROUND ART

The development of a direct injection gasoline engine (downsizing engine) equipped with a supercharger device such as a turbocharger is recently progressing at a rapid rate. The direct injection of a gasoline engine has a merit of fuel efficiency improvement, but has a demerit similarly to a diesel engine, in that soot of particulate matter (PM), etc. contained in an exhaust gas is generated. Thus, a direct injection gasoline engine equipped with exhaust gas treatment equipment having a gasoline particulate filter (GPF) in addition to an exhaust gas purification catalyst is becoming widespread.

In addition, there are visible movements which will further tighten exhaust gas regulations in the future. Thus, a possibility that similarly to a direct injection gasoline engine, all gasoline cars will be required to be equipped with exhaust gas treatment equipment having a gasoline particulate filter (GPF) may be fully considered.

There is a concern about a possibility that a lubricant composition may affect such exhaust gas treatment equipment. Specifically, when a lubricant composition containing a metal-based detergent is used, there is a concern about a possibility that the filter may be clogged with a metal content derived from the metal-based detergent. In addition, there is a concern that the activity of the catalyst may decrease. As a countermeasure for this, ash content reduction of the lubricant composition is required.

For example, PTL 1 discloses a lubricant composition for an internal combustion engine, in which a calcium-based detergent is blended such that the sulfate ash content is 0.7% by mass or less.

CITATION LIST

Patent Literature

PTL 1: JP 2000-256690 A

SUMMARY OF INVENTION

Technical Problem

Meanwhile, from the viewpoint of further reducing the influence on the exhaust gas treatment equipment, it may be thought that further reducing the ash content in the lubricant composition will be required in the lubricant composition in the future. In addition, it is strongly required to provide a lubricant composition excellent in a long drainage property.

However, it was not easy to achieve both an ash content reduction and a long drainage property of the lubricant composition.

An object of the present invention is to provide a lubricant composition and a method of producing the same, in which both an ash content reduction and a long drainage property are achieved.

Solution to Problem

The present inventor has conducted intensive studies to solve the above-mentioned problems. As a result, it has been found that the above-mentioned problems can be solved when a specific calcium-based detergent and a specific ashless detergent are combined, and at the same time, the calcium atom content of the specific calcium-based detergent and the nitrogen atom content of the specific ashless detergent are adjusted to a specific ratio, and the calcium atom content in the lubricant composition is adjusted to a specific range.

That is, the present invention relates to the followings [1] to [10].

[1] A lubricant composition containing:

a base oil (A), at least one kind of calcium-based detergent (B) selected from (B1) calcium sulfonate having a base number of 5.00 mgKOH/g or more and 100 mgKOH/g or less, (B2) calcium salicylate having a branched acyclic hydrocarbon group, and (B3) overbased calcium phenate having a branched acyclic hydrocarbon group, and at least one kind of ashless detergent (C) selected from (C1) a hindered amine compound having one piperidine-derived backbone in a molecule, and (C2) a diethanolamine compound represented by the following general formula (1),

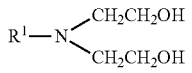

(1)

(wherein $R^1$ is a monovalent aliphatic hydrocarbon group having 12 to 30 carbon atoms)

in which a calcium atom content is 100 ppm by mass or more and 600 ppm by mass or less with respect to a total mass of the lubricant composition, and a ratio ($N_C/Ca_B$) of a nitrogen atom content ($N_C$) of the ashless detergent (C) to a calcium atom content ($Ca_B$) of the calcium-based detergent (B) is 1.3 to 3.1 as a mass ratio.

[2] In the lubricant composition described in the above [1], a base number of (B2) the calcium salicylate is 5.00 mgKOH/g or more and 600 mgKOH/g or less.

[3] In the lubricant composition described in the above [1] or [2], a calcium atom content ($Ca_{CaCO3}$) of calcium carbonate derived from the calcium-based detergent (B) is 400 ppm by mass or less with respect to the total mass of the lubricant composition.

[4] In the lubricant composition described in any one of the above [1] to [3], the nitrogen atom content ($N_C$) of the ashless detergent (C) is 100 ppm by mass or more and 1700 ppm by mass or less with respect to the total mass of the lubricant composition.

[5] In the lubricant composition described in any one of the above [1] to [4], a sulfate ash content of the lubricant composition is 0.60% by mass or less.

[6] In the lubricant composition described in any one of the above [1] to [5], an initial base number of the lubricant composition is 5.00 mgKOH/g or more.

[7] A lubricant composition that contains the lubricant composition described in any one of the above [1] to [6], and is used for an internal combustion engine.

[8] A lubricant composition that contains the lubricant composition described in any one of the above [1] to [6], and is used for a turbo mechanism-equipped engine.

[9] A lubricant composition that contains the lubricant composition described in any one of the above [1] to [6], and is used for a gasoline engine or a diesel engine equipped with a particulate filter.

[10] A method of producing a lubricant composition, the method including carrying out preparation of the lubricant composition that contains:

a base oil (A), at least one kind of calcium-based detergent (B) selected from (B1) calcium sulfonate having a base number of 5.00 mgKOH/g or more and 100 mgKOH/g or less, (B2) calcium salicylate having a branched acyclic hydrocarbon group, and (B3) overbased calcium phenate having a branched acyclic hydrocarbon group; and at least one kind of ashless detergent (C) selected from (C1) a hindered amine compound having one piperidine-derived backbone in a molecule, and (C2) a diethanolamine compound represented by the following general formula (1),

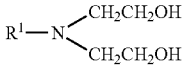

(1)

(wherein $R^1$ is a monovalent aliphatic hydrocarbon group having 12 to 30 carbon atoms)

wherein the preparation is carried out to satisfy following conditions (1) and (2).

Condition (1): a calcium atom content is 100 ppm by mass or more and 600 ppm by mass or less with respect to a total mass of the lubricant composition.

Condition (2): a ratio ($N_C/Ca_B$) of a nitrogen atom content ($N_C$) of the ashless detergent (C) to a calcium atom content ($Ca_B$) of the calcium-based detergent (B) is 1.3 to 3.1 as a mass ratio.

Advantageous Effects of Invention

According to the present invention, it is possible to provide a lubricant composition and a method of producing the same, in which both the ash content reduction and the long drainage property are achieved.

DESCRIPTION OF EMBODIMENTS

Hereinafter, an embodiment for carrying out the present invention will be described in detail.

In the present specification, in relation to a preferable numerical range (for example, a range of a content, etc.), lower limit values and upper limit values described stepwise may be independently combined with each other. For example, from the description "preferably 10 to 90, more preferably 30 to 60," "a preferable lower limit value (10)" and "a more preferable upper limit value (60)" may be combined into "10 to 60."

Likewise, in the present specification, numeral values in "greater than or equal to," "less than or equal to," "less than," and "greater than" regarding the description of a numerical range are also numerical values that may be arbitrarily combined.

In the present specification, the "long drainage property" refers to an ability to suppress the deterioration of a lubricant composition over a long period of time and to prolong a replacement interval of the lubricant composition. Specifically, this means that an initial base number of the lubricant composition is increased so that the base number maintainability is improved and then high temperature cleanliness is maintained.

In the present specification, the "base number maintainability" refers to an ability to maintain the base number of the lubricant composition over a long period of time even under an environment similar to the inside of an internal combustion engine exposed to water and heat.

In the present specification, the "high temperature cleanliness" refers to an ability to prevent dirt (such as sludge or deposits) or deposited substance generated in the lubricant composition from adhering to the inside of the internal combustion engine even if the lubricant composition is deteriorated under a high temperature environment similar to the inside of the internal combustion engine, and to keep the inside of a lubrication path in a piston or around the piston clean.

In the present specification, the "detergent" refers to an additive having a function of preventing and suppressing deposition of a deteriorated substance mainly in a high temperature operation.

[Lubricant Composition]

A lubricant composition of the present invention is a lubricant composition containing a base oil (A), at least one kind of calcium-based detergent (B) selected from (B1) calcium sulfonate having a base number of 5.00 mgKOH/g or more and 100 mgKOH/g or less, (B2) calcium salicylate having a branched acyclic hydrocarbon group, and (B3) overbased calcium phenate having a branched acyclic hydrocarbon group, and at least one kind of ashless detergent (C) selected from (C1) a hindered amine compound having one piperidine-derived backbone in a molecule, and (C2) a diethanolamine compound represented by the following general formula (1),

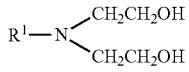

(1)

(In the general formula (1), $R^1$ is a monovalent aliphatic hydrocarbon group having 12 to 30 carbon atoms)

in which in the lubricant composition, the calcium atom content is 100 ppm by mass or more and 600 ppm by mass or less with respect to the total mass of the lubricant composition, and the ratio ($N_C/Ca_B$) of the nitrogen atom content ($N_C$) of the ashless detergent (C) to the calcium atom content ($Ca_B$) of the calcium-based detergent (B) is 1.3 to 3.1 as a mass ratio.

From the viewpoint of further reducing the influence on the exhaust gas treatment equipment, further reducing the ash content in the lubricant composition is required in the future. As a method of realizing the further reduction of the ash content in the lubricant composition, changing a metal-based detergent into an ashless detergent may be exemplified. However, a lubricant composition containing the ashless detergent is generally inferior in high temperature cleanliness. Thus, it is not easy to provide a lubricant composition excellent in the long drainage property, by using the ashless detergent.

In addition, as another method of realizing the further reduction of the ash content in the lubricant composition, reducing the amount of a metal-based detergent may be exemplified. However, when the amount of the metal-based detergent is reduced, a lubricant composition containing the metal-based detergent may not have a sufficiently high initial base number. In addition, the base number maintainability may be degraded, and the high temperature cleanliness may be degraded. Thus, it is not easy to provide a lubricant composition excellent in the long drainage property by reducing the amount of the metal-based detergent.

Due to these reasons, it has been thought that even if the ash content of a lubricant composition is reduced through combination of a metal-based detergent and an ashless detergent, it is not easy to provide a lubricant composition excellent in the long drainage property.

Regarding such a situation, the present inventor has conducted intensive studies so as to provide a lubricant composition in which both the ash content reduction and the long drainage property are achieved. As a result, a group of amine-based compounds having a high initial base number has been found among ashless detergents. Then, it has been found that when among these, a specific amine-based compound and a specific calcium-based detergent are combined at a specific ratio, the above-mentioned problems can be solved even if the calcium atom content of the lubricant composition is low.

In the present specification, in the following descriptions, the "base oil (A)," the "calcium-based detergent (B)," and the "ashless detergent (C)" are also referred to as a "component (A)," a "component (B)," and a "component (C)," respectively.

The lubricant composition according to an aspect of the present invention may contain additives for a lubricating oil besides the component (A), the component (B), and the component (C) within a range where the effect of the present invention is not impaired.

In the lubricant composition according to an aspect of the present invention, the total content of the component (A), the component (B), and the component (C) is preferably 70% by mass or more, more preferably 75% by mass or more, further preferably 80% by mass or more with respect to the total mass of the lubricant composition.

In the lubricant composition according to an aspect of the present invention, the upper limit value of the total content of the component (A), the component (B), and the component (C) may be adjusted in relation to the contents of the additives for the lubricating oil other than the component (A), the component (B), and the component (C), and is preferably 90% by mass or less, more preferably 89% by mass or less, further preferably 88% by mass or less.

Hereinafter, each component contained in the lubricant composition of the present invention will be described in detail.

<Base Oil (A)>

The lubricant composition of the present invention contains a base oil (A).

As the base oil (A) contained in the lubricant composition of the present invention, at least one kind selected from mineral oils and synthetic oils that have conventionally been used as a base oil for a lubricating oil may be used without particular limitation.

Examples of the mineral oil include an atmospheric residual oil obtained by subjecting a crude oil such as a paraffin-based crude oil, an intermediate-based crude oil, or a naphthene-based crude oil, to atmospheric distillation; a distilled oil obtained by distilling the atmospheric residual oil under reduced pressure; and a mineral oil obtained by subjecting the distilled oil to one or more refining treatments such as solvent removal, solvent extraction, hydrocracking, solvent wintering, catalytic wintering, and hydrorefining.

Examples of the synthetic oil include poly-α-olefin such as an α-olefin homopolymer or an α-olefin copolymer (for example, an α-olefin copolymer having 8 to 14 carbon atoms such as an ethylene-α-olefin copolymer); isoparaffin; various esters such as polyol ester and dibasic acid ester; various ethers such as polyphenyl ether; polyalkylene glycol; alkyl benzene; alkyl naphthalene; and GTL base oil obtained by isomerizing wax (Gas to Liquid (GTL) wax) produced by a Fischer-Tropsch method or the like from natural gas.

As the base oil (A) used in an aspect of the present invention, a base oil classified into Group 2, 3 or 4 in base stock categories of the API (American Petroleum Institute) is preferred, and a base oil classified into Group 2 or 3 is more preferred.

As the base oil (A), the mineral oil may be used either alone or in combination of two or more types thereof, or the synthetic oil may be used either alone or in combination of two or more types thereof. In addition, at least one type of mineral oil and at least one kind of synthetic oil may be used in combination.

The kinematic viscosity of the base oil (A) at 100° C. is preferably 2.0 to 15.0 $mm^2/s$, more preferably 2.5 to 10.0 $mm^2/s$, further preferably 3.0 to 8.0 $mm^2/s$.

When the kinematic viscosity of the base oil (A) at 100° C. is 2.0 $mm^2/s$ or more, it is easy to suppress the evaporation loss.

When the kinematic viscosity of the base oil (A) at 100° C. is 15.0 $mm^2/s$ or less, a power loss caused by viscous resistance may be suppressed, and thus it is easy to obtain a fuel efficiency improving effect.

From the viewpoint of suppressing a change in viscosity due to a temperature change and at the same time, improving fuel-saving properties, the viscosity index of the base oil (A) is preferably 80 or more, more preferably 100 or more, further preferably 120 or more.

In the present specification, the kinematic viscosity and the viscosity index mean values obtained through measurement or calculation in accordance with JIS K2283:2000.

In addition, in an aspect of the present invention, when the base oil (A) is a mixed base oil containing two or more types of base oils, it is desirable that the kinematic viscosity and the viscosity index of the mixed base oil fall within the above-mentioned ranges.

In the lubricant composition according to an aspect of the present invention, the content of the base oil (A) is preferably 90% by mass or less with respect to the total mass of the lubricant composition (based on 100% by mass). When the content of the base oil (A) is 90% by mass or less, it is possible to sufficiently secure the use amount of the calcium-based detergent (B) and the ashless detergent (C), and thus it is possible to more easily exhibit the long drainage property improving effect occurring through a combined use of the calcium-based detergent (B) and the ashless detergent (C).

From the viewpoint of more easily improving the effect of the present invention, the content of the base oil (A) is preferably 60 to 90% by mass, more preferably 70 to 87% by mass, further preferably 75 to 85% by mass with respect to the total mass of the lubricant composition.

<Calcium-Based Detergent (B)>

The lubricant composition of the present invention contains a calcium-based detergent (B).

The calcium-based detergent (B) contained in the lubricant composition of the present invention is at least one kind selected from (B1) calcium sulfonate having a base number of 5.00 mgKOH/g or more and 100 mgKOH/g or less, (B2)

calcium salicylate having a branched acyclic hydrocarbon group, and (B3) overbased calcium phenate having a branched acyclic hydrocarbon group.

In the following descriptions, (B1) the calcium sulfonate having a base number of 5.00 mgKOH/g or more and 100 mgKOH/g or less, (B2) the calcium salicylate having a branched acyclic hydrocarbon group and (B3) the overbased calcium phenate having a branched acyclic hydrocarbon group are also referred to as a "component (B1)," a "component (B2)," and a "component (B3)," respectively.

Hereinafter, the component (B1), the component (B2), and the component (B3) will be described in detail.

In the present specification, the "hydrocarbon group" means a group composed of only a carbon atom and a hydrogen atom.

(Component (B1): Calcium Sulfonate)

The component (B1) is calcium sulfonate having a base number of 5.00 mgKOH/g or more and 100 mgKOH/g or less.

When calcium sulfonate, which is a neutral salt having a base number falling within the above-mentioned range, is used, the long drainage property improving effect is achieved through combination with the ashless detergent (C).

When the base number of the component (B1) is less than 5.00 mgKOH/g, the initial base number of the lubricant composition may not be sufficiently increased. In addition, when the base number of the component (B1) is greater than 100 mgKOH/g, the lubricant composition is inferior in high temperature cleanliness.

Here, in an aspect of the present invention, from the viewpoint of easily exhibiting the long drainage property improving effect through combination with the ashless detergent (C), the base number of the component (B1) is preferably 5.00 mgKOH/g or more and 80.0 mgKOH/g or less, more preferably 5.00 mgKOH/g or more and 60.0 mgKOH/g or less, further preferably 5.00 mgKOH/g or more and 40.0 mgKOH/g or less, still more preferably 5.00 mgKOH/g or more and 20.0 mgKOH/g or less, even more preferably 10.0 mgKOH/g or more and 20.0 mgKOH/g or less.

In the present specification, the base number of the calcium-based detergent (B) is a value measured by a potentiometric titration method (base number perchloric acid method) in accordance with JIS K2501: 2003-9.

Here, in an aspect of the present invention, the component (B1) is preferably calcium sulfonate represented by the following general formula (B1-1) from the viewpoint of more easily exhibiting the long drainage property improving effect through combination with the ashless detergent (C).

(B1-1)

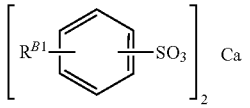

In the general formula (B1-1), each of two RBI's independently represents a monovalent acyclic hydrocarbon group.

The number of carbon atoms in the monovalent acyclic hydrocarbon group is preferably 3 to 26, more preferably 7 to 24, further preferably 10 to 22.

The monovalent acyclic hydrocarbon group may be a saturated acyclic hydrocarbon group or an unsaturated acyclic hydrocarbon group.

The saturated acyclic hydrocarbon group is preferably a linear or branched alkyl group, and also, the unsaturated acyclic hydrocarbon group is preferably a linear or branched alkenyl group.

The monovalent acyclic hydrocarbon group is more preferably a linear or branched alkyl group.

The number of carbon atoms in the alkyl group or the alkenyl group is preferably 3 to 26, more preferably 7 to 24, further preferably 10 to 22.

Specific examples of the alkyl group include a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, a tetracosyl group, a pentacosyl group, and a hexacosyl group. These may have a linear form or a branched form.

Specific examples of the alkenyl group include a propenyl group, a butenyl group, a penthenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group, a tetracosenyl group, a pentacosenyl group, and a hexacosenyl group. These may have a linear form or a branched form.

The component (B1) may be used either alone or in combination of two or more types thereof.

(Component (B2): Calcium Salicylate)

The component (B2) is calcium salicylate having a branched acyclic hydrocarbon group.

When the calcium salicylate having a branched acyclic hydrocarbon group is used, the long drainage property improving effect is exhibited through combination with the ashless detergent (C).

Here, in an aspect of the present invention, from the viewpoint of more easily exhibiting the long drainage property improving effect through combination with the ashless detergent (C), the component (B2) is preferably calcium salicylate represented by the following general formula (B2-1).

(B2-1)

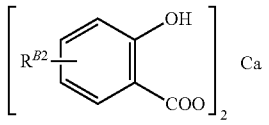

In the general formula (B2-1), each of two $R^{B2}$'s independently represents a monovalent acyclic hydrocarbon group. Meanwhile, at least one of two $R^{B2}$'s represents a branched monovalent acyclic hydrocarbon group.

The number of carbon atoms in the monovalent acyclic hydrocarbon group is preferably 3 to 26, more preferably 5 to 24, further preferably 8 to 20, still further preferably 10 to 18.

Here, at least one of two $R^{B2}$'s may be a branched monovalent acyclic hydrocarbon group, but it is desirable that both are branched monovalent acyclic hydrocarbon groups. In addition, the monovalent acyclic hydrocarbon group may be a saturated acyclic hydrocarbon group or an unsaturated acyclic hydrocarbon group, but a saturated acyclic hydrocarbon group is preferred.

In an aspect of the present invention, it is desirable that one of two $R^{B2}$'s is a branched alkyl group or a branched alkenyl group, and the other is a linear or branched alkyl group or a linear or branched alkenyl group, it is more desirable that both are branched alkyl groups or branched alkenyl groups, and it is further desirable that both are branched alkyl groups.

The number of carbon atoms in the alkyl group or the alkenyl group is preferably 3 to 26, more preferably 5 to 24, further preferably 8 to 20, still further preferably 10 to 18.

Specific examples of the alkyl group or the alkenyl group include the same as those listed as $R^{B1}$ in the general formula (B1-1).

Here, in an aspect of the present invention, the component (B2) may be any of a neutral salt, a basic salt, and an overbased salt, and the base number is not particularly limited, but is preferably 5.00 mgKOH/g or more and 600 mgKOH/g or less, more preferably 10.0 mgKOH/g or more and 500 mgKOH/g or less, further preferably 20.0 mgKOH/g or more and 400 mgKOH/g or less, still further preferably 30.0 mgKOH/g or more and 350 mgKOH/g or less, even more preferably 40.0 mgKOH/g or more and 300 mgKOH/g or less from the viewpoint of easily exhibiting the long drainage property improving effect through combination with the ashless detergent (C).

Here, from the viewpoint of more easily exhibiting the long drainage property improving effect through combination with the ashless detergent (C), the component (B2) is preferably a neutral salt or an overbased salt, more preferably a neutral salt.

In the present specification, the overbased salt means that the base number is 200 mgKOH/g or more, and the neutral salt means that the base number is 100 mgKOH/g or less. In addition, the basic salt means that the base number is greater than 100 mgKOH/g and less than 200 mgKOH/g.

When the component (B2) is the overbased salt, the base number of the component (B2) is specifically preferably 200 mgKOH/g or more and 600 mgKOH/g or less, more preferably 200 mgKOH/g or more and 500 mgKOH/g or less, further preferably 200 mgKOH/g or more and 400 mgKOH/g or less, still more preferably 200 mgKOH/g or more and 300 mgKOH/g or less, even more preferably 200 mgKOH/g or more and 250 mgKOH/g or less.

When the component (B2) is the neutral salt, the base number of the component (B2) is specifically preferably 5.00 mgKOH/g or more and 100 mgKOH/g or less, more preferably 10.0 mgKOH/g or more and 100 mgKOH/g or less, further preferably 20.0 mgKOH/g or more and 100 mgKOH/g or less, still more preferably 30.0 mgKOH/g or more and 90.0 mgKOH/g or less, even more preferably 40.0 mgKOH/g or more and 80.0 mgKOH/g or less.

The component (B2) may be used either alone or in combination of two or more kinds thereof.

(Component (B3): Calcium Phenate)

The component (B3) is overbased calcium phenate having a branched acyclic hydrocarbon group.

When the overbased calcium phenate having a branched acyclic hydrocarbon group is used, the long drainage property improving effect is exhibited through combination with the ashless detergent (C).

Here, in an aspect of the present invention, from the viewpoint of more easily exhibiting the long drainage property improving effect through combination with the ashless detergent (C), the base number of the component (B3) is preferably 200 mgKOH/g or more and 450 mgKOH/g or less, more preferably 210 mgKOH/g or more and 400 mgKOH/g or less, further preferably 220 mgKOH/g or more and 300 mgKOH/g or less, still further preferably 220 mgKOH/g or more and 280 mgKOH/g or less.

Here, in an aspect of the present invention, the component (B3) is preferably calcium phenate represented by the following general formula (B3-1) from the viewpoint of more easily exhibiting the long drainage property improving effect through combination with the ashless detergent (C).

(B3-1)

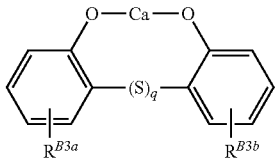

In the general formula (B3-1), each of $R^{B3a}$ and $R^{B3b}$ independently represents a monovalent acyclic hydrocarbon group. Meanwhile, at least one of $R^{B3a}$ and $R^{B3b}$ represents a branched monovalent acyclic hydrocarbon group.

q is an integer of 0 or more, and is preferably an integer of 0 to 3.

The number of carbon atoms in the branched acyclic hydrocarbon group is preferably 3 to 26, more preferably 5 to 24, further preferably 8 to 20, still more preferably 10 to 16.

Here, at least one of $R^{B3a}$ and $R^{B3b}$ may be a branched monovalent acyclic hydrocarbon group, but it is desirable that both are branched monovalent acyclic hydrocarbon groups. In addition, the monovalent acyclic hydrocarbon group may be a saturated acyclic hydrocarbon group or an unsaturated acyclic hydrocarbon group, but a saturated acyclic hydrocarbon group is preferred.

In an aspect of the present invention, it is desirable that one of $R^{B3a}$ and $R^{B3b}$ is a branched alkyl group or a branched alkenyl group, and the other is a linear or branched alkyl group or a linear or branched alkenyl group, it is more desirable that both are branched alkyl groups or branched alkenyl groups, and it is further desirable that both are branched alkyl groups.

The number of carbon atoms in the alkyl group or the alkenyl group is preferably 3 to 26, more preferably 5 to 24, further preferably 8 to 20, still further preferably 10 to 16.

Specific examples of the alkyl group or the alkenyl group include the same as those listed as $R^{B1}$ in the general formula (B1-1).

The component (B3) may be used either alone or in combination of two or more types thereof.

(Preferable Component as Component (B))

In an aspect of the present invention, from the viewpoint of further improving the long drainage property through combination with the ashless detergent (C), the component (B) is preferably at least one kind selected from the component (B1), the component (B2) which is calcium salicylate having a base number of 5.00 mgKOH/g or more and 100 mgKOH/g or less, and the component (B3), and is more preferably at least one kind selected from the component (B1), and the component (B2) which is calcium salicylate having a base number of 5.00 mgKOH/g or more and 100 mgKOH/g or less.

(Calcium Atom Content ($Ca_{CaCO3}$) in Calcium Carbonate Derived from Component (B))

In an aspect of the present invention, the calcium atom content ($Ca_{CaCO3}$) in calcium carbonate derived from the component (B) is not particularly limited, but is preferably 400 ppm by mass or less with respect to the total mass of the lubricant composition from the viewpoint of obtaining the lubricant composition more excellent in the base number maintainability and the high temperature cleanliness.

In the calcium carbonate is a compound produced through the reaction between carbon dioxide present under a synthetic environment or carbon dioxide blown under a synthetic environment, and calcium, when the component (B) is produced.

In addition, from the viewpoint of further improving the base number maintainability, the calcium atom content ($Ca_{CaCO3}$) of calcium carbonate derived from the component (B) is more preferably 350 ppm by mass or less, further preferably 300 ppm by mass or less, still more preferably 250 ppm by mass or less, even more preferably 200 ppm by mass or less.

In addition, it is generally 50 ppm by mass or more.

(Calcium Atom Content ($Ca_B$) of Component (B))

In an aspect of the present invention, the calcium atom content ($Ca_B$) of the component (B) is not particularly limited, but is preferably 90 to 590 ppm by mass, more preferably 150 to 580 ppm by mass, further preferably 200 to 570 ppm by mass, still more preferably 250 to 560 ppm by mass, even more preferably 300 to 550 ppm by mass with respect to the total mass of the lubricant composition from the viewpoint of easily obtaining the lubricant composition in which both the ash content reduction and the long drainage property are achieved.

(Content of Component (B))

In an aspect of the present invention, it is desirable that the content of the component (B) is adjusted such that the calcium atom content of the component (B) falls within the above-mentioned range. Specifically, it is preferably 0.100 to 3.00% by mass, more preferably 0.150 to 2.80% by mass, further preferably 0.200 to 2.60% by mass, even more preferably 0.250 to 2.40% by mass with respect to the total mass of the lubricant composition from the viewpoint of easily obtaining the lubricant composition in which both the ash content reduction and the long drainage property are achieved.

The lubricant composition according to an aspect of the present invention may contain another metal-based detergent besides the component (B) within a range where the effect of the present invention is not impaired, but it is desirable that the content of the other metal-based detergent besides the component (B) is low.

Examples of the other metal-based detergent include at least one type selected from calcium sulfonate other than the component (B1), calcium salicylate other than the component (B2), calcium phenate other than the component (B3), and a metal-based detergent containing a metal atom other than calcium.

Specifically, examples of calcium sulfonate other than the component (B1) include calcium sulfonate having a base number greater than 100 mgKOH/g.

Examples of calcium salicylate other than the component (B2) include calcium salicylate not having a branched acyclic hydrocarbon group.

Examples of calcium phenate other than the component (B3) include neutral or basic calcium phenate having a branched acyclic hydrocarbon group.

Examples of the metal-based detergent containing a metal atom other than calcium include a metal-based detergent containing at least one type of metal atom selected from sodium, magnesium, and barium.

In an aspect of the present invention, the content of another metal-based detergent besides the component (B) is preferably less than 10 parts by mass, more preferably less than 5 parts by mass, further preferably less than 1 parts by mass with respect to 100 parts by mass of the total mass of the component (B), from the viewpoint of more easily exhibiting the long drainage property improving effect through combination with the ashless detergent (C). It is even more desirable that the other metal-based detergent besides the component (B) is not contained.

In the component (B) in the lubricant composition according to an aspect of the present invention, the content of at least one kind of calcium-based detergent selected from the component (B1), the component (B2), and the component (B3) is preferably 70 to 100% by mass, more preferably 80 to 100% by mass, further preferably 90 to 100% by mass, still more preferably 95 to 100% by mass, even more preferably 99 to 100% by mass with respect to the total mass of the component (B).

<Ashless Detergent (C)>

The lubricant composition of the present invention contains an ashless detergent (C).

The ashless detergent (C) contained in the lubricant composition of the present invention is at least one kind selected from (C1) a hindered amine compound having one piperidine-derived backbone per molecule, and (C2) a diethanolamine compound represented by the following general formula (1).

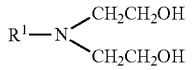

(1)

(In the general formula (1), $R^1$ is a monovalent aliphatic hydrocarbon group having 12 to 30 carbon atoms)

In the following descriptions, (C1) the hindered amine compound having one piperidine-derived backbone per molecule and (C2) the diethanolamine compound represented by the general formula (1) are also referred to as a "component (C1)" and a "component (C2)," respectively.

Hereinafter, the component (C1) and the component (C2) will be described in detail.

(Component (C1): Hindered Amine Compound)

The component (C1) is a hindered amine compound having one piperidine-derived backbone in a molecule.

When the hindered amine compound having one piperidine-derived backbone in a molecule is used, the long drainage property improving effect is exhibited through combination with the calcium-based detergent (B).

When the hindered amine compound having two or more piperidine-derived backbones in a molecule is used, the long drainage property improving effect through combination with the calcium-based detergent (B) is not exhibited.

Here, in an aspect of the present invention, from the viewpoint of more easily exhibiting the long drainage property improving effect through a combined use with the calcium-based detergent (B), the component (C1) is preferably at least one kind selected from hindered amine compounds represented by the following general formula (C1-1) and the following general formula (C1-2).

(C1-1)

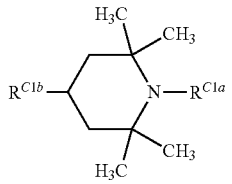

(C1-2)

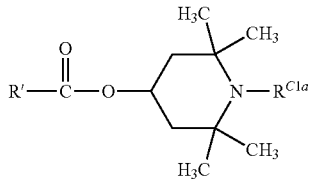

In the general formulas (C1-1) and (C1-2), each of $R^{C1a}$'s is independently a hydrogen atom or an alkyl group having 1 to 10 carbon atoms, preferably a hydrogen atom or an alkyl group having 1 to 3 carbon atoms, more preferably a hydrogen atom.

In the general formula (C1-1), $R^{C1b}$ is a hydrogen atom, an alkyl group having 1 to 20 carbon atoms, a cycloalkyl group having 6 to 18 ring carbon atoms, an aryl group having 6 to 18 ring carbon atoms, a hydroxy group, or a group represented by —O—CO—R' (R' is a hydrogen atom or an alkyl group having 1 to 20 carbon atoms).

In the general formula (C1-2), R' is a hydrogen atom or an alkyl group having 1 to 20 carbon atoms, preferably an alkyl group having 1 to 20 carbon atoms, more preferably an alkyl group having 5 to 15 carbon atoms.

The component (C1) may be used either alone or in combination of two or more kinds thereof.

(Component (C2): Diethanolamine Compound)

The component (C2) is a diethanolamine compound represented by the following general formula (1).

When the diethanolamine compound is used, the long drainage property improving effect through combination with the calcium-based detergent (B) is exhibited.

Even when an amine compound having a similar structure to the diethanolamine compound, for example, monoalkanolamine, is used, the long drainage property improving effect through combination with the calcium-based detergent (B) is not exhibited.

(1)

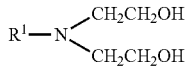

In the general formula (1), $R^1$ is a monovalent aliphatic hydrocarbon group having 12 to 30 carbon atoms.

Preferred examples of the aliphatic hydrocarbon group having 12 to 30 carbon atoms as $R^1$ include a linear or branched alkyl group having 12 to 30 carbon atoms or a linear or branched alkenyl group having 12 to 30 carbon atoms. The number of carbon atoms in these groups is more preferably 12 to 24, further preferably 16 to 20.

When $R^1$ is an aliphatic hydrocarbon group having the above-mentioned number of carbon atoms, the long drainage property improving effect through combination with the calcium-based detergent (B) is exhibited.

Examples of the linear or branched alkyl group having 12 to 30 carbon atoms include various dodecyl groups such as an n-dodecyl group, an isododecyl group, a sec-dodecyl group, a tert-dodecyl group, and a neododecyl group (hereinafter, functional groups having a predetermined number of carbon atoms, which include a linear form, a branched form, and isomers thereof, may be abbreviated as "various functional groups"), various tridecyl groups, various tetradecyl groups, various pentadecyl groups, various hexadecyl groups, various heptadecyl groups, various octadecyl groups, various nonadecyl groups, various eicosyl groups, various heneicosyl groups, various docosyl groups, various tricosyl groups, various tetracosyl groups, various pentacosyl groups, various hexacosyl groups, various heptacosyl groups, various octacosyl groups, various nonacosyl groups, and various triacontyl groups.

In addition, examples of the linear or branched alkenyl group having 12 to 30 carbon atoms include various dodecenyl groups, various tridecenyl groups, various tetradecenyl groups, various pentadecenyl groups, various hexadecenyl groups, various heptadecenyl groups, various octadecenyl groups, various nonadecenyl groups, various eicosenyl groups, various heneicosenyl groups, various docosenyl groups, various tricosenyl groups, various tetracosenyl groups, various pentacosenyl groups, various hexacosenyl groups, various heptacosenyl groups, various octacosenyl groups, various nonacosenyl groups, and various triacontinyl groups.

Among them, in consideration of the long drainage property improving effect, various hexadecyl groups, various heptadecyl groups, and various octadecyl groups, which are alkyl groups having 16 to 18 carbon atoms, and various hexadecenyl groups, various heptadecenyl groups, and various octadecenyl groups, which are alkenyl groups having 16 to 18 carbon atoms, are preferred, various hexadecyl groups, various octadecyl groups, and various octadecenyl groups are more preferred, and an n-hexadecyl group (palmityl group), an n-octadecyl group (stearyl group), and an n-octadecenyl group (oleyl group) are further preferred.

Examples of the particularly preferable specific compound as (C2) the diethanolamine compound represented by the general formula (1) include at least one type selected from stearyldiethanolamine (in the general formula (1), $R^1$ is an n-octadecyl group (stearyl group)), oleyldiethanolamine (in the general formula (1), $R^1$ is an n-octadecenyl group (oleyl group)), and palmityldiethanolamine (in the general formula (1), $R^1$ is an n-hexadecyl group (palmityl group)).

The component (C2) may be used either alone or in combination of two or more types thereof.

(Preferable Component as Component (C))

In an aspect of the present invention, from the viewpoint of further improving the long drainage property through combination with the calcium-based detergent (B), the component (C) is preferably at least one kind selected from the component (C1).

(Nitrogen Atom Content ($N_C$) of Component (C))

In an aspect of the present invention, the nitrogen atom content ($N_C$) of the component (C) is not particularly limited, but is preferably 100 to 1700 ppm by mass, more preferably 400 to 1600 ppm by mass, further preferably 600 to 1400 ppm by mass, still more preferably 600 to 1300 ppm by mass with respect to the total mass of the lubricant composition from the viewpoint of easily obtaining the lubricant composition in which both the ash content reduction and the long drainage property are achieved.

(Content of Component (C))

In an aspect of the present invention, it is desirable that the content of the component (C) is adjusted such that the nitrogen atom content of the component (C) falls within the above-mentioned range. Specifically, it is preferably 1.00 to 5.00% by mass, more preferably 1.50 to 4.50% by mass, further preferably 2.00 to 4.00% by mass with respect to the total mass of the lubricant composition from the viewpoint of easily obtaining the lubricant composition in which both the ash content reduction and the long drainage property are achieved.

The lubricant composition according to an aspect of the present invention may contain another ashless detergent besides the component (C) within a range where the effect of the present invention is not impaired, but it is desirable that the content of the other ashless detergent besides the component (C) is low.

Examples of the other ashless detergent include a hindered amine compound other than the component (C1), that is, a compound having two or more piperidine-derived backbones. In addition, alkanolamine other than the component (C2) may be exemplified.

In an aspect of the present invention, the content of another ashless detergent besides the component (C) is preferably less than 10 parts by mass, more preferably less than 5 parts by mass, further preferably less than 1 part by mass, with respect to 100 parts by mass of the total mass of the component (C) from the viewpoint of more easily exhibiting the long drainage property improving effect through combination with the calcium-based detergent (B). It is even more desirable that the other ashless detergent besides the component (C) is not contained.

In the component (C) in the lubricant composition according to an aspect of the present invention, the content of at least one type of ashless detergent selected from the component (C1) and the component (C2) is preferably 70 to 100% by mass, more preferably 80 to 100% by mass, further preferably 90 to 100% by mass, still more preferably 95 to 100% by mass, even more preferably 99 to 100% by mass with respect to the total mass of the component (C).

<Ratio of Calcium-Based Detergent (B) to Ashless Detergent (C)>

In the lubricant composition of the present invention, the ratio ($N_C/Ca_B$) of the nitrogen atom content ($N_C$) of the ashless detergent (C) to the calcium atom content ($Ca_B$) of the calcium-based detergent (B) is 1.3 to 3.1 as a mass ratio.

When $N_C/Ca_B$ is less than 1.3, the base number maintainability of the lubricant composition is degraded.

When $N_C/Ca_B$ is greater than 3.1, the high temperature cleanliness of the lubricant composition is degraded.

Here, in an aspect of the present invention, from the viewpoint of obtaining the lubricant composition more excellent in the long drainage property, $N_C/Ca_B$ is preferably 1.4 to 3.1, more preferably 1.6 to 3.1, further preferably 1.7 to 3.1, still more preferably 1.8 to 3.0, even more preferably 1.9 to 2.9, further more preferably 2.0 to 2.8, still further more preferably 2.1 to 2.7.

In addition, when the ashless detergent (C) is (C1) the hindered amine compound, from the viewpoint of obtaining the lubricant composition more excellent in the long drainage property, $N_C/Ca_B$ is preferably 1.4 to 3.1, more preferably 1.6 to 3.0, further preferably 1.8 to 2.9, still more preferably 1.8 to 2.8, even more preferably 1.8 to 2.7.

In addition, when the ashless detergent (C) is (C2) the diethanolamine compound, from the viewpoint of obtaining the lubricant composition more excellent in the long drainage property, $N_C/Ca_B$ is preferably 1.4 to 3.1, more preferably 1.8 to 3.1, further preferably 1.9 to 3.1, still more preferably 2.0 to 3.1, even more preferably 2.1 to 3.0.

<Other Additives for Lubricating Oil>

The lubricant composition according to an aspect of the present invention may contain other additives for a lubricating oil, which do not correspond to the component (B) and the component (C), within a range where the effect of the present invention is not impaired.

Examples of other additives for a lubricating oil include an anti-wear agent, an extreme pressure agent, a metallic friction modifier, an antioxidant, an ashless dispersant, an ashless friction modifier, a viscosity index improver, a pour-point depressant, a rust inhibitor, an anti-foaming agent, a metal deactivator, and an anti-emulsifier.

Each of these additives for a lubricating oil may be either used alone or in combination of two or more kinds thereof.

The content of each of these additives for a lubricating oil may be properly adjusted within a range where the effect of the present invention is not impaired, but is generally 0.001 to 15% by mass, preferably 0.005 to 10% by mass, more preferably 0.01 to 8% by mass, further preferably 0.1 to 6% by mass with respect to the total mass (100% by mass) of the lubricant composition.

In the present specification, an additive such as a viscosity index improver or an anti-foaming agent may be formed into a solution diluted and dissolved in a part of the above-mentioned base oil (A), and then may be blended with other components in consideration of the handleability or the solubility in the base oil (A). In such a case, in the present specification, the above-mentioned content of the additive such as the anti-foaming agent or the viscosity index improver means the content obtained through conversion of an active ingredient (resin content conversion) excluding dilution oil.

(Anti-Wear Agent, Extreme Pressure Agent)

Examples of the anti-wear agent or the extreme pressure agent include zinc phosphate; sulfur-containing compounds such as zinc dithiophosphate, zinc dithiocarbamate, molybdenum dithiocarbamate, molybdenum dithiophosphate, disulfides, olefin sulfides, sulfurized oils and fats, sulfurized esters, thiocarbonates, thiocarbamates, and polysulfides; phosphorus-containing compounds such as phosphite esters, phosphate esters, phosphonate esters, and amine salts or metal salts thereof; and sulfur- and phosphorus-containing compounds such as thiophosphite esters, thiophosphate esters, thiophosphonate esters, and amine salts or metal salts thereof.

These may be used either alone or in combination of two or more kinds.

Here, in an aspect of the present invention, the anti-wear agent or the extreme pressure agent is preferably zinc dithiophosphate.

(Zinc Dithiophosphate)

Examples of the zinc dithiophosphate include a compound represented by the following general formula (D-1).

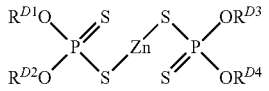

(D-1)

(In the formula, each of $R^{D1}$ to $R^{D4}$ independently represents a hydrocarbon group having 1 to 24 carbon atoms)

Examples of the hydrocarbon group represented by $R^{D1}$ to $R^{D4}$ include a linear or branched alkyl group having 1 to 24 carbon atoms, a linear or branched alkenyl group having 3 to 24 carbon atoms, a linear or branched alkylcycloalkyl group or a cycloalkyl group having 5 to 13 carbon atoms, a linear or branched alkylaryl group or an aryl group having 6 to 18 carbon atoms, and an arylalkyl group having 7 to 19 carbon atoms. Among them, a linear or branched alkyl group having 1 to 24 carbon atoms is preferred, and a branched alkyl group having 1 to 24 carbon atoms is more preferred. The number of carbon atoms in the branched alkyl group is preferably 2 to 12, more preferably 4 to 10. Examples of the branched alkyl group having 1 to 24 carbon atoms include an iso-propyl group, an iso-butyl group, a sec-butyl group, a tert-butyl group, an iso-pentyl group, a tert-pentyl group, an iso-hexyl group, a 2-ethylhexyl group, an iso-nonyl group, an iso-decyl group, an iso-tridecyl group, an iso-stearyl group, and an iso-eicosyl group. Among them, a 2-ethylhexyl group is preferred.

As zinc dithiophosphate, specifically, zinc dialkyklithiophosphate is preferred, and among them, secondary zinc dialkyklithiophosphate is more preferred.

The zinc dithiophosphate may be used either alone or in combination of two or more types thereof.

In an aspect of the present invention, the content of a phosphorus atom derived from zinc dithiophosphate is preferably less than 700 ppm by mass, more preferably less than 650 ppm by mass, further preferably less than 620 ppm by mass from the viewpoint of suppressing poisoning of an exhaust gas purification catalyst, and also is preferably 100 ppm by mass or more, more preferably 400 ppm by mass or more from the viewpoint of improving wear resistance.

In an aspect of the present invention, the content of zinc dithiophosphate is preferably adjusted such that the content of the phosphorus atom of the zinc dithiophosphate falls within the above-mentioned range, and is specifically preferably less than 1.5% by mass, more preferably less than 1.4% by mass, further preferably less than 1.3% by mass, still more preferably less than 1.2% by mass with respect to the total mass (100% by mass) of the lubricant composition from the viewpoint of suppressing poisoning of the exhaust gas purification catalyst, and is also preferably 0.1% by mass or more, more preferably 0.5% by mass or more from the viewpoint of improving wear resistance.

(Metallic Friction Modifier)

Examples of the metallic friction modifier include organic molybdenum-based compounds such as molybdenum dithiocarbamate (MoDTC), molybdenum dithiophosphate (MoDTP), and an amine salt of molybdate. Among them, at least one type selected from molybdenum dithiocarbamate (MoDTC) and molybdenum dithiophosphate (MoDTP) is preferred, and molybdenum dithiocarbamate (MoDTC) is more preferred.

(Molybdenum Dithiocarbamate (MoDTC))

Examples of the molybdenum dithiocarbamate include binuclear molybdenum dithiocarbamate having two molybdenum atoms in one molecule thereof, and trinuclear molybdenum dithiocarbamate having three molybdenum atoms in one molecule thereof.

In the present invention, molybdenum dithiocarbamate may be used either alone or in combination of two or more kinds thereof.

As the binuclear molybdenum dithiocarbamate, a compound represented by the following general formula (E1-1), and a compound represented by the following general formula (E1-2) are preferred.

(E1-1)

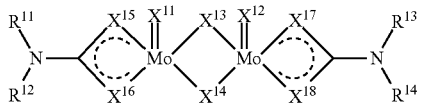

-continued (E1-2)

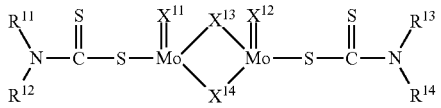

In the general formulas (E1-1) and (E1-2), each of $R^{11}$ to $R^{14}$ independently represents a hydrocarbon group, and these may be the same or different from each other.

Each of $X^{11}$ to $X^{18}$ independently represents an oxygen atom or a sulfur atom, and these may be the same or different from each other. Meanwhile, at least two of $X^{11}$ to $X^{18}$ in the formula (E1-1) are sulfur atoms.

In an aspect of the present invention, it is desirable that $X^{11}$ and $X^{12}$ in the formula (E1-1) are oxygen atoms, and $X^{13}$ to $X^{18}$ are sulfur atoms.

In the general formula (E1-1), the molar ratio [sulfur atom/oxygen atom] of a sulfur atom to an oxygen atom in $X^{11}$ to $X^{18}$ is preferably 1/4 to 4/1, more preferably 1/3 to 3/1 from the viewpoint of improving the solubility in the base oil (A).

In addition, it is desirable that $X^{11}$ to $X^{14}$ in the formula (E1-2) are oxygen atoms.

The number of carbon atoms in the hydrocarbon group that may be selected as $R^{11}$ to $R^{14}$ is preferably 7 to 22, more preferably 7 to 18, further preferably 7 to 14, still more preferably 8 to 13.

Examples of the hydrocarbon group that may be selected as $R^{11}$ to $R^{14}$ in the general formulas (E1-1) and (E1-2) include an alkyl group, an alkenyl group, a cycloalkyl group, an aryl group, an alkylaryl group, and an arylalkyl group, and an alkyl group is preferred.

Examples of the alkyl group include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include an octenyl group, a nonenyl group, a decenyl group, an undecenyl group, a dodecenyl group, a tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group, a methylbenzyl group, and a dimethylnaphthyl group.

Examples of the arylalkyl group include a phenylmethyl group, a phenylethyl group, and a diphenylmethyl group.

As the trinuclear molybdenum dithiocarbamate, a compound represented by the following general formula (E1-3) is preferred.

$$Mo_3S_kE_mL_nA_pQ_z \quad \text{(E1-3)}$$

In the general formula (E1-3), k is an integer of 1 or more, m is an integer of 0 or more, and k+m is an integer of 4 to 10, and preferably an integer of 4 to 7. n is an integer of 1 to 4, and p is an integer of 0 or more. z is an integer of 0 to 5, inclusive of non-stoichiometric value.

Each E is independently an oxygen atom or a selenium atom, and is, for example, one that can be a substitute for sulfur in a core to be described below.

Each L is independently an anionic ligand having a carbon atom-containing organic group, in which the sum of carbon atoms of the organic group in each of ligands is 14 or more, and the ligands may be the same or different from each other.

Each A is independently an anion other than L.

Each Q is independently a compound that donates neutral electrons, and exists to fulfil a vacant coordination site on the trinuclear molybdenum compound.

In an aspect of the present invention, the molybdenum atom content in molybdenum dithiocarbamate (MoDTC) is preferably 200 to 1,000 ppm by mass, more preferably 300 to 950 ppm by mass, further preferably 350 to 900 ppm by mass, still more preferably 400 to 800 ppm by mass with respect to the total mass of the lubricant composition. When the molybdenum content falls within the above-mentioned range, an excellent friction reducing effect may be obtained. Obtaining the excellent friction reducing effect is also desirable from the viewpoint of a fuel saving performance.

In an aspect of the present invention, the content of molybdenum dithiocarbamate (MoDTC) is preferably adjusted such that the molybdenum atom content of the molybdenum dithiocarbamate (MoDTC) falls within the above-mentioned range, and is specifically preferably 0.20 to 1.0% by mass, more preferably 0.30 to 0.95% by mass, further preferably 0.35 to 0.90% by mass, still more preferably 0.40 to 0.80% by mass, with respect to the total mass of the lubricant composition.

(Molybdenum Dithiophosphate (MoDTP))

As molybdenum dithiophosphate, a compound represented by the following general formula (E2-1) and a compound represented by the following general formula (E2-2) are preferred.

In the present invention, molybdenum dithiophosphate may be used either alone or in combination of two or more kinds thereof.

(E2-1)

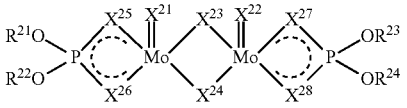

(E2-2)

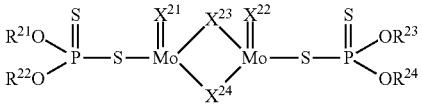

In the general formulas (E2-1) and (E2-2), each of $R^{21}$ to $R^{24}$ independently represents a hydrocarbon group, and these may be the same or different from each other.

Each of $X^{21}$ to $X^{28}$ independently represents an oxygen atom or a sulfur atom, and these may be the same or different from each other. Meanwhile, at least two of $X^{21}$ to $X^{28}$ in the formula (E2-1) are sulfur atoms.

In an aspect of the present invention, it is desirable that $X^{21}$ and $X^{22}$ in the general formula (E2-1) are oxygen atoms, and $X^{23}$ to $X^{28}$ are sulfur atoms.

In the general formula (E2-1), the molar ratio [sulfur atom/oxygen atom] of a sulfur atom to an oxygen atom in $X^{21}$ to $X^{28}$ is preferably 1/4 to 4/1, more preferably 1/3 to 3/1 from the viewpoint of improving the solubility in the base oil (A).

In addition, it is desirable that $X^{21}$ and $X^{22}$ in the general formula (E2-2) are oxygen atoms, and $X^{23}$ and $X^{24}$ are sulfur atoms.

In the general formula (E2-2), from the same viewpoint as above, the molar ratio [sulfur atom/oxygen atom] of a sulfur atom to an oxygen atom in $X^{21}$ to $X^{24}$ is preferably 1/3 to 3/1, more preferably 1.5/2.5 to 2.5/1.5.

The number of carbon atoms in the hydrocarbon group that may be selected as $R^{21}$ to $R^{24}$ is preferably 1 to 20, more preferably 5 to 18, further preferably 5 to 16, still further preferably 5 to 12.

Examples of the specific hydrocarbon group that may be selected as $R^{21}$ to $R^{24}$ include the same as hydrocarbon groups that may be selected as $R^{11}$ to $R^{14}$ in the general formula (E1-1) or (E1-2).

In an aspect of the present invention, it is desirable that the content of a molybdenum atom derived from molybdenum dithiophosphate (MoDTP) is low from the viewpoint of obtaining the lubricant composition with a high initial base number, and from the viewpoint of suppressing poisoning of the exhaust gas purification catalyst by phosphorus. It is preferably 1000 ppm by mass or less, more preferably 900 ppm by mass or less, further preferably 800 ppm by mass or less, still more preferably 700 ppm by mass or less.

In addition, from the viewpoint of improving the friction reducing effect, it is preferably 100 ppm by mass or more, more preferably 400 ppm by mass or more. Meanwhile, when the friction reducing effect can be sufficiently exhibited only by molybdenum thiocarbamate (MoDTC), the lubricant composition according to an aspect of the present invention may not contain molybdenum dithiophosphate (MoDTP).

In an aspect of the present invention, the content of molybdenum dithiophosphate (MoDTP) is preferably adjusted such that the molybdenum atom content of molybdenum dithiophosphate (MoDTP) falls within the above-mentioned range, and is specifically preferably 1.2% by mass or less, more preferably 1.1% by mass or less, further preferably 1.0% by mass or less, still more preferably 0.9% by mass or less, even more preferably 0.8% by mass or less with respect to the total mass of the lubricant composition. In addition, it is preferably 0.1% by mass or more, more preferably 0.5% by mass or more. Meanwhile, as described above, when the friction reducing effect can be sufficiently exhibited only by molybdenum thiocarbamate (MoDTC), the lubricant composition according to an aspect of the present invention may not contain molybdenum dithiophosphate (MoDTP).

(Antioxidant)

Examples of the antioxidant include an amine-based antioxidant, a phenol-based antioxidant, a molybdenum-based antioxidant, a sulfur-based antioxidant, and a phosphorus-based antioxidant.

Among them, from the viewpoint of suppressing clogging of a GPF and suppressing poisoning of the exhaust gas purification catalyst, it is desirable to use an amine-based antioxidant, a phenol-based antioxidant, and a sulfur-based antioxidant which do not contain metal and phosphorus, and it is more desirable to use an amine-based antioxidant and a phenol-based antioxidant. In addition, it is further desirable to use an amine-based antioxidant and a phenol-based antioxidant in combination. Through a combined use of the amine-based antioxidant and the phenol-based antioxidant, the phenol-based antioxidant more effectively acts mainly on the initial stage of oxidation, and due to synergy caused by the use in combination with the amine-based antioxidant, the oxidative stability and the friction reducing effect can be maintained for a longer period of time than those in the case where each is used alone.

When the amine-based antioxidant and the phenol-based antioxidant are used in combination, the content ratio (X/Y) of the amine-based antioxidant (X) to the phenol-based antioxidant (Y) is preferably 1/5 to 20/5 as a mass ratio, more preferably 3/5 to 17/5, further preferably 5/5 to 15/5.

(Amine-Based Antioxidant)

Examples of the amine-based antioxidant include a diphenylamine-based one such as diphenylamine, and monoalkyldiphenylamine having an alkyl group having 3 to 20 carbon atoms or clialkyldiphenylamine having an alkyl group having 3 to 20 carbon atoms; and a naphthylamine-based one such as α-naphthylamine, and alkyl-substituted phenyl-α-naphthylamine having 3 to 20 carbon atoms. Specific examples include a monoalkyldiphenylamine-based one such as monooctyldiphenyl amine and monononyldiphenylamine; a clialkyldiphenylamine-based one such as dibutyldiphenylamine, dipentyldiphenylamine, dihexyldiphenylamine, diheptyldiphenylamine, dioctyldiphenylamine, and dinonyldiphenylamine; tetrabutyldiphenylamine, tetrahexyldiphenylamine; a polyalkyldiphenylamine-based one such as tetraoctyldiphenylamine and tetranonyldiphenylamine; and α-naphthylamine, and phenyl-α-naphthylamine, and further include alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, octylphenyl-α-naphthylamine, and nonylphenyl-α-naphthylamine.

These may be used either alone or in combination of two or more kinds.

(Phenol-based Antioxidant)

Examples of the phenol-based antioxidant include 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N'-dimethylaminomethyl)phenol, 2,6-di-tert-amyl-4-methylphenol, 2,6-di-tert-amyl-p-cresol, 4,4'-methylenebis (2,6-di-tert-butylphenol), 4,4'-bis(2,6-di-tert-butylphenol), 4,4'-bis(2-methyl-6-tert-butylphenol), 2, 2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidene bis(2,6-di-tert-butylphenol), 2,2'-methylenebis(4-methyl-6-nonylphenol), 2,2'-isobutylidene bis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-cli-tert-butyl-4-hydroxybenzyl)sulfide, 2,2'-thio-diethylenebis[3-(3,5-cli-tert-butyl-4-hydroxyphenyl)propionate], tridecyl-3-(3,5-di-tert-butyl-4-hydroxyphenyl)propionate, pentaerythritol tetrakis [3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, and octyl-3-(3-methyl-5-tert-butyl-4-hydroxyphenyl)propionate.

These may be used either alone or in combination of two or more kinds.

(Ashless Dispersant)

Examples of the ashless dispersant include boron-free succinimides, boron-containing succinimides, benzylamines, boron-containing benzylamines, succinic acid esters, and monovalent or divalent carboxylic acid amides typified by fatty acids or succinic acids.

These may be used either alone or in combination of two or more types.

Among them, it is desirable to use boron-free succinimides, and boron-containing succinimides, and it is more desirable to use a combination of boron-free succinimides and boron-containing succinimides.

(Ashless Friction Modifier)

Examples of the ashless friction modifier include an alkyl group or an alkenyl group having 6 to 30 carbon atoms, especially fatty acid amine, fatty acid ester, fatty acid amide, fatty acid, aliphatic alcohol, and fatty acid ether, each having at least one linear alkyl group or linear alkenyl group having 6 to 30 carbon atoms in a molecule.

These may be used either alone or in combination of two or more types.

(Viscosity Index Improver)

Examples of the viscosity index improver include polymers such as non-dispersion type polymethacrylate, dispersion type polymethacrylate, olefin-based copolymer (for example, ethylene-propylene copolymer, etc.), dispersion type olefin-based copolymer, and styrene-based copolymer (for example, styrene diene copolymer, styrene-isoprene copolymer, etc.).

These may be used either alone or in combination of two or more types.

The mass average molecular weight (Mw) of these viscosity index improvers is generally 500 to 1,000,000, preferably 5,000 to 100,000, more preferably 10,000 to 50,000, but is properly set according to the type of a polymer.

In the present specification, the mass average molecular weight (Mw) of each component is a standard polystyrene-equivalent value measured by a gel permeation chromatography (GPC) method.

(Pour-Point Depressant)

Examples of the pour-point depressant include ethylene-vinyl acetate copolymer, condensate of chlorinated paraffin and naphthalene, condensate of chlorinated paraffin and phenol, polymethacrylate, and polyalkylstyrene.

These may be used either alone or in combination of two or more kinds.

(Rust Inhibitor)

Examples of the rust inhibitor include fatty acid, alkenyl succinic acid half-ester, fatty acid soap, alkylsulfonic acid salt, polyhydric alcohol fatty acid ester, fatty acid amine, oxidized paraffin, and alkyl polyoxyethylene ether.

These may be used either alone or in combination of two or more kinds.

(Metal Deactivator)

Examples of the metal deactivator include a benzotriazole-based compound, a tolyl triazole-based compound, a thiadiazole-based compound, an imidazole-based compound, and a pyrimidine-based compound.

These may be used either alone or in combination of two or more kinds.

(Anti-Emulsifier)

Examples of the anti-emulsifier include anionic surfactants such as ester sulfate salt of castor oil, and petroleum sulfonic acid salt; cationic surfactants such as quaternary ammonium salt, and imidazolines; esters of polyoxyalkylene polyglycols and dicarboxylic acids thereof; and alkylene oxide adducts of alkylphenol-formaldehyde polycondensate.

These may be used either alone or in combination of two or more kinds.

(Anti-Foaming Agent)

Examples of the anti-foaming agent include a silicone oil, a fluorosilicone oil, and a fluoroalkyl ether.

These may be used either alone or in combination of two or more kinds.

[Properties of Lubricant Composition]

<Calcium Atom Content>

In the lubricant composition of the present invention, the calcium atom content is 100 ppm by mass or more and 600 ppm by mass or less. Even though the calcium atom content is low as described above, the lubricant composition of the present invention is excellent in the high temperature cleanliness. In addition, the initial base number is also high, and the base number maintainability is also excellent. Thus, the ash content is low and at the same time the long drainage property is excellent. Further, since the calcium atom content is low, clogging of a gasoline particulate filter (GPF) is suppressed in the exhaust gas treatment equipment.

<Sulfate Ash Content>

In the lubricant composition according to an aspect of the present invention, the sulfate ash content is preferably 0.60% by mass or less, more preferably 0.58% by mass or less, further preferably 0.56% by mass or less, still more preferably 0.54% by mass or less, even more preferably 0.52% by mass or less.

Even though the sulfate ash content is low as described above, the lubricant composition according to an aspect of the present invention is excellent in the high temperature cleanliness. In addition, since the sulfate ash content is low, clogging of the gasoline particulate filter (GPF) in the exhaust gas treatment equipment, and further, activity reduction of the exhaust gas purification catalyst are suppressed.

In the present specification, the sulfate ash content means a value measured in accordance with JIS K2272:1998.

<Kinematic Viscosity>

In the lubricant composition according to an aspect of the present invention, the kinematic viscosity at 100° C. is preferably 6.0 to 10 $mm^2/s$, more preferably 6.0 to 9.5 $mm^2/s$, further preferably 6.5 to 9.0 $mm^2/s$.

<Viscosity Index>

In the lubricant composition according to an aspect of the present invention, the viscosity index is preferably 180 to 230, more preferably 185 to 225, further preferably 190 to 220.

<Initial Base Number>

The lubricant composition according to an aspect of the present invention has a high initial base number. Specifically, the initial base number is preferably 5.00 mgKOH/g or more, more preferably 5.20 mgKOH/g or more, further preferably 5.40 mgKOH/g or more. In addition, it is preferably 8.00 mgKOH/g or less.

The lubricant composition according to an aspect of the present invention has a high initial base number, and is also excellent in the base number maintainability. Thus, it is possible to secure the high base number for a long period of time and then it is easy to improve the long drainage property.

The initial base number is a value measured by a method described in Examples to be described below.

<Base Number Maintainability at Exposure to Water>

The lubricant composition according to an aspect of the present invention is excellent in the base number maintainability at exposure to water. Specifically, the base number maintenance rate after a water resistance test carried out by a method described in Examples to be described below is preferably 70% or more, more preferably 75% or more, further preferably 80% or more, still more preferably 85% or more.

<Base Number Maintainability at Exposure to Heat>

The lubricant composition according to an aspect of the present invention is excellent in the base number maintainability at exposure to heat. Specifically, the base number maintenance rate in a heat resistance test carried out by a method described in Examples to be described below is preferably 40% or more, more preferably 45% or more, further preferably 50% or more, still more preferably 55% or more, even more preferably 60% or more, still further more preferably 65% or more.

<High Temperature Cleanliness>

The lubricant composition according to an aspect of the present invention is excellent in the high temperature cleanliness. Specifically, the score in a hot tube test carried out by a method described in Examples to be described below is preferably 6 or more, more preferably 7 or more, further preferably 8 or more.

[Use of Lubricant Composition]

The lubricant composition according to an aspect of the present invention may be preferably used as a lubricant composition for a gasoline engine, a diesel engine, a gas engine, etc. in automobiles such as two-wheeled vehicles and four-wheeled vehicles, power generators, ships, etc., and is very suitable especially for an internal combustion engine (for example, a direct injection gasoline engine equipped with a supercharger device such as a supercharger or a turbocharger, that is, a downsizing engine) and a diesel engine, which are equipped with exhaust gas treatment equipment having a particulate filter, due to its low ash content. In addition, the lubricant composition is capable of sufficiently coping with the tightening of exhaust gas regulations in the future.

Then, the lubricant composition according to an aspect of the present invention is filled in these internal combustion engines, especially, an engine equipped with a turbo mechanism, and a gasoline engine or a diesel engine equipped with exhaust gas treatment equipment having a particulate filter, and then is very suitably used to lubricate each part related to these internal combustion engines.

Therefore, according to an aspect of the present invention, there is provided a method of lubricating an internal combustion engine by using the lubricant composition. In addition, there is provided a method of lubricating a turbo mechanism-equipped engine by using the lubricant composition. Further, there is provided a method of lubricating a gasoline engine or a diesel engine equipped with exhaust gas treatment equipment having a particulate filter by using the lubricant composition.

[Method of Producing Lubricant Composition]

The method of producing the lubricant composition of the present invention is not particularly limited For example, the method of producing the lubricant composition according to an aspect of the present invention includes steps of carrying out preparation of a lubricant composition that contains a base oil (A), at least one kind of calcium-based detergent (B) selected from (B1) calcium sulfonate having a base number of 5.00 mgKOH/g or more and 100 mgKOH/g or less, (B2) calcium salicylate having a branched acyclic hydrocarbon group, and (B3) overbased calcium phenate having a branched acyclic hydrocarbon group, and at least one kind of ashless detergent (C) selected from (C1) a hindered amine compound having one piperidine-derived backbone in a molecule, and (C2) a diethanolamine compound represented by the following general formula (1),

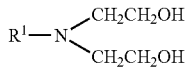

(1)

(In the general formula (1), $R^1$ is a monovalent aliphatic hydrocarbon group having 12 to 30 carbon atoms)

in which in the method of producing the lubricant composition, the preparation is carried out to satisfy the following conditions (1) and (2).

condition (1): the calcium atom content is 100 ppm by mass or more and 600 ppm by mass or less with respect to the total mass of the lubricant composition.

condition (2): the ratio ($N_C/Ca_B$) of the nitrogen atom content ($N_C$) of the ashless detergent (C) to the calcium atom content ($Ca_B$) of the calcium-based detergent (B) is 1.3 to 3.1 as a mass ratio.

The method of mixing the components is not particularly limited, but examples thereof include a method having a step of blending the component (B) and the component (C) with the base oil (A). In addition, not only the components (A) to (C), but also the above-mentioned other additives for a lubricating oil may be blended at the same time. In addition, each component may be formed into a solution (dispersion) through addition of dilution oil or the like and then may be blended. It is desirable that the components are blended, and then uniformly dispersed through stirring by a conventionally known method.

EXAMPLES

Hereinafter, the present invention will be more specifically described with reference to Examples. Meanwhile, the present invention is not limited by the following Examples.

[Each Property/Status Measurement]

In the present specification, property/status measurements on each raw material used in each of Examples and Comparative Examples and each lubricant composition in each of Examples and Comparative Examples were carried out according to the manner described below.

<Kinematic Viscosity (100° C. kinematic viscosity) and Viscosity Index>

Measurement or calculation was performed by using a capillary viscometer made of glass, in accordance with JIS K2283:2000.

<Base Number (Hydrochloric Acid Method)>

The base number of the calcium-based detergent (B) was measured by a potentiometric titration method (base number perchloric acid method) in accordance with JIS K2501:2003-9.

The initial base number of the lubricant composition, the base number after the water resistance test, and the base number after the heat resistance test were measured by a potentiometric titration method (base number hydrochloric acid method) in accordance with JIS K2501:2003-8.

<Content of Calcium Atom (Ca)>

Measurement was performed in accordance with JPI-5S-38-2003.

<Content of Nitrogen Atom (N)>

Measurement was performed by a chemiluminescence method in accordance with JIS K2609:1998.

<Sulfate Ash Content>

Measurement was performed in accordance with JIS K2272:1998.

Examples 1 to 15 and Comparative Examples 1 to 9

Base oils and various additives described below were added according to blending amounts (% by mass) described in Table 1-1 to Table 1-4, and sufficiently mixed to prepare lubricant compositions. The kinematic viscosities of the lubricant compositions at 100° C. were adjusted to 7.4 $mm^2/s$ to 7.7 $mm^2/s$.

Details of base oils and various additives used in Examples 1 to 15 and Comparative Examples 1 to 9 are the same as described below.

<Base Oil (A)>

Mineral oil base oil: 100° C. kinematic viscosity; 4.1 $mm^2/s$, viscosity index; 125, API classification; group 3

<Calcium-Based Detergent (B)>

(Component (B1))

Ca sulfonate (1): Ca sulfonate having a linear acyclic hydrocarbon group, base number: 18.1 mgKOH/g (neutral salt), Ca atom content: 2.4% by mass, $CaCO_3$ content: 1% by mass Ca sulfonate (2): Ca sulfonate having a branched acyclic hydrocarbon group, base number: 11.3 mgKOH/g (neutral salt), Ca atom content: 2.2% by mass, $CaCO_3$ content: 1% by mass (component (B2))

Ca salicylate (1): Ca salicylate having a branched acyclic hydrocarbon group, base number: 59.8 mgKOH/g (neutral salt), Ca atom content: 2.3% by mass, $CaCO_3$ content: 2% by mass Ca salicylate (2): Ca salicylate having a branched acyclic hydrocarbon group, base number: 219 mgKOH/g (overbased salt), Ca atom content: 7.9% by mass, $CaCO_3$ content: 15% by mass (Component (B3))

Ca phenate (1): Ca phenate having a branched acyclic hydrocarbon group, base number: 253 mgKOH/g (overbased salt), Ca atom content: 9.1% by mass, $CaCO_3$ content: 24% by mass <Calcium-Based Detergent (B') for Comparison>

Ca sulfonate (3): Ca sulfonate having a linear acyclic hydrocarbon group, base number: 426 mgKOH/g (overbased salt), Ca atom content: 15.8% by mass, $CaCO_3$ content: 37% by mass Ca sulfonate (4): Ca sulfonate having a branched acyclic hydrocarbon group, base number: 304 mgKOH/g (overbased salt), Ca atom content: 11.7% by mass, $CaCO_3$ content: 27% by mass <Ashless Detergent (C)>

(Component (C1))

Hindered amine compound (1): a hindered amine compound having one piperidine-derived backbone (a monohindered amine compound, manufactured by BASF, product name: XPDL590, nitrogen content: 4.2% by mass)

The hindered amine compound (1) is a hindered amine compound, in which in the general formula (C1-2), R' is a dodecyl group.

(Component (C2))

Diethanolamine: a mixture of a compound having a stearyl group as $R^1$ in the general formula (1), a compound having an oleyl group as $R^1$, and a compound having a palmityl group as $R^1$. nitrogen content: 4.2% by mass.

<Ashless Detergent (C') for Comparison>

Hindered amine compound (2): a hindered amine compound having two piperidine-derived backbones (bis hindered amine compound, manufactured by BASF, product name: Tinuvin765, nitrogen content: 5.3% by mass)

Hindered amine compound (3): a hindered amine compound having two piperidine-derived backbones (bis hindered amine compound, manufactured by BASF, product name: Tinuvin770DF, nitrogen content: 5.3% by mass)

<Other Additives for Lubricating Oil>

(Zinc dialkyldithiophosphate)

ZnDTP: zinc dialkyldithiophosphate having a sec-2-ethylhexyl group as an alkyl group (alkyl compound having sec-2-ethylhexyl groups as $R^{D1}$ to $R^{D4}$ in the general formula (D-1)), phosphorus atom content=7.1% by mass.

(Organic Molybdenum-based Compound)

Molybdenum dithiocarbamate (MoDTC): manufactured by ADEKA Corporation, product name: Sakura-Lube 525, molybdenum content 10.0% by mass, sulfur content 11.0% by mass The molybdenum dithiocarbamate is binuclear molybdenum dithiocarbamate represented by the general formula (E1-2) in which each of $R^{11}$ to $R^{14}$ has 8 or 13 carbon atoms, and $X^1$ to $X^4$ are oxygen atoms.

Molybdenum dithiophosphate (MoDTP): ADEKA Sakura-Lube 300, molybdenum content 9.0% by mass, sulfur content 10.1% by mass (Antioxidant)

Phenol-based antioxidant mine-based antioxidant (Ashless Dispersant)

Non-borylated succinimide

Borylated succinimide (Other Additives for Lubricating Oil)

Poly(meth)acrylate

[Various Measurement and Test Methods]

The evaluation methods for the lubricant compositions in Examples and Comparative Examples are as follows.

<Initial Base Number>

The initial base number of the prepared lubricant composition was measured by the above-mentioned method, and one having an initial base number of 5.00 mgKOH/g or more was determined to be excellent.

<Water Resistance Evaluation>

100 g of sample oil, 3 g of distilled water and a copper plate were placed in a glass bottle and sealed. This glass bottle was placed in a constant temperature bath kept at 62° C., and was rotated at 5 rpm for 24h while being turned upside down once during one rotation. After the operation, the base number (hydrochloric acid method) of the sample oil was measured by using the same method as the above-mentioned method. The copper plate (material: C1100P, size: 51 mm (length)×13 mm (width)×1 mm (thickness)) was used after polished until a new surface appeared. The base number measured in the water resistance evaluation is called "the base number after the water resistance test."

Then, by using the base number after the water resistance test and the initial base number, "the base number maintenance rate (%) after the water resistance test" was calculated by the following equation.

(base number maintenance rate (%) after water resistance test)=(base number after water resistance test)/(initial base number)×100

In these Examples, when the base number maintenance rate after the water resistance test is 70% or more, the base number maintainability at exposure to water is determined to be excellent, and when the base number maintenance rate after the water resistance test is less than 70%, the base number maintainability at exposure to water is determined to be poor.

<Heat Resistance Evaluation: NOx Test>

100 g of sample oil was placed in a glass tube and an oil temperature was adjusted to 140° C. Air (flow rate: 100 mL/min) and nitric oxide (NO) diluted with nitrogen (NO concentration: 4,000 vol ppm) (flow rate: 100 mL/min) were mixed, and introduced into the sample oil at an oil temperature of 140° C. so as to prepare NOx degraded oil for 20h.

The base number (hydrochloric acid method) of the NOx degraded oil was measured by using the same method as the above-mentioned method. The base number measured in the heat resistance evaluation is called "the base number after the heat resistance test."

Then, by using the base number after the heat resistance test and the initial base number, "the base number maintenance rate after the heat resistance test" was calculated by the following equation.

(base number maintenance rate (%) after heat resistance test)=(base number after heat resistance test)/(initial base number)×100

In these Examples, when the base number maintenance rate after the heat resistance test is 40% or more, the base number maintainability at exposure to heat is determined to be excellent, and when the base number maintenance rate after the heat resistance test is less than 40%, the base number maintainability at exposure to heat is determined to be poor.

In addition, to the NOx degraded oil prepared by the above-mentioned method, 1% by mass of 1-ethyl-4-nitrobenzene was added to prepare a test oil.

Then, a glass tube having an inner diameter of 2 mm was set vertically in a heater block; the adjusted test oil and air were sent at rates of 0.3 ml/h and 10 ml/min, respectively, from a lower part of the glass tube; and a hot tube test was performed for 16 h while the temperature of the heater section was kept at 240° C.

After the hot tube test was carried out for 16 h, the adhesion status of deposit (deposited substance) adhering to the inside of the glass tube was evaluated by scores in 1-point increments in a range of 0 points (black) to 10 points (colorless; deposit is not accumulated).

It can be said that as the number of the score is larger, the lubricant composition has a smaller volume of deposit and more excellent high-temperature cleanliness. In these Examples, for 6 points or more, the high temperature cleanliness was determined to be excellent, and for 5 points or less, the high temperature cleanliness was determined to be poor.

The results are noted in Table 1-1 to Table 1-4.

In Table 1-1 to Table 1-4, $Ca_B$ in the calcium-based detergent used to calculate "$N_C/Ca_B$ derived from detergents" means a total content of calcium atoms in salts and calcium carbonate in the calcium-based detergent.

In addition, the "Ca atom content in the lubricant composition" in Table 1-1 to Table 1-4 is also the Ca atom content $Ca_B$ in the calcium-based detergent because in these Examples, except for the calcium-based detergent, there is nothing containing the calcium content.

TABLE 1-1

| | | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Lubricant Composition | Base oil (A) | | 80.93 | 80.72 | 80.84 | 80.14 | 81.54 | 80.84 | 80.14 | 81.54 |
| | Calcium-based detergent (B) | Ca sulfonate (1): base number: 18.1 mgKOH/g, linear structure | 2.07 | — | — | — | — | — | — | — |
| | | Ca sulfonate (2): base number: 11.3 mgKOH/g, branched structure | — | 2.28 | — | — | — | — | — | — |
| | | Ca salicylate (1): base number: 59.8 mgKOH/g, branchedstructure | — | — | 2.16 | 2.16 | 2.16 | 2.16 | 2.16 | 2.16 |
| | | Ca salicylate (2): base number: 219 mgKOH/g, branched structure | — | — | — | — | — | — | — | — |
| | | Ca phenate (1): base number: 253 mgKOH/g, branched structure | — | — | — | — | — | — | — | — |
| | Calcium-based detergent (B) | Ca sulfonate (3): base number: 426 mgKOH/g, linear structure | — | — | — | — | — | — | — | — |
| | | Ca sulfonate (4): base number: 304 mgKOH/g, branched structure | — | — | — | — | — | — | — | — |
| | Ashless detergent (C) | Hindered amine compound (1): number of piperidine-derived backbones: 1 | 2.80 | 2.80 | 2.80 | 3.50 | 2.10 | — | — | — |
| | | Diethanolamine | — | — | — | — | — | 2.80 | 3.50 | 2.10 |
| | Ashless detergent (C') | Hindered amine compound (2): number of piperidine-derived backbones: 2 | — | — | — | — | — | — | — | — |
| | | Hindered amine compound (3): number of piperidine-derived backbones: 2 | — | — | — | — | — | — | — | — |
| | Zinc dialkyldithio-phosphate | ZnDTP | 1.10 | 1.10 | 1.10 | 1.10 | 1.10 | 1.10 | 1.10 | 1.10 |
| | Organic molybdenum-based compound | MoDTC | 0.70 | 0.70 | 0.70 | 0.70 | 0.70 | 0.70 | 0.70 | 0.70 |
| | | MoDTP | — | — | — | — | — | — | — | — |
| | Antioxidant | Phenol-based antioxidant | 0.50 | 0.50 | 0.50 | 0.50 | 0.50 | 0.50 | 0.50 | 0.50 |
| | | Amine-based antioxidant | 1.00 | 1.00 | 1.00 | 1.00 | 1.00 | 1.00 | 1.00 | 1.00 |
| | Ashless dispersant | Non-borylated succinimide | 3.00 | 3.00 | 3.00 | 3.00 | 3.00 | 3.00 | 3.00 | 3.00 |
| | | Borylated succinimide | 2.00 | 2.00 | 2.00 | 2.00 | 2.00 | 2.00 | 2.00 | 2.00 |
| | Other additives for lubricant oil | | 5.90 | 5.90 | 5.90 | 5.90 | 5.90 | 5.90 | 5.90 | 5.90 |
| | Total | | 100 | 100 | 100 | 100 | 100 | 100 | 100 | 100 |
| | Initial base number (mgKOH/g) | | 5.55 | 5.51 | 6.49 | 7.73 | 5.50 | 6.55 | 7.79 | 5.59 |
| | Sulfate ash content (% by mass) | | 0.5 | 0.5 | 0.5 | 0.5 | 0.5 | 0.5 | 0.5 | 0.5 |
| | Ca atom content in lubricant composition (ppm by mass) | | 500 | 500 | 500 | 500 | 500 | 500 | 500 | 500 |
| | Calcium-based detergent-derived Ca content $Ca_B$ (ppm by mass) | | 500 | 500 | 500 | 500 | 500 | 500 | 500 | 500 |
| | $CaCO_3$-derived Ca content $Ca_{CaCO3}$ (ppm by mass) | | 80 | 90 | 170 | 170 | 170 | 170 | 170 | 170 |
| | N atom content in lubricant composition (ppm by mass) | | 2100 | 2100 | 2100 | 2300 | 1800 | 2000 | 2400 | 2100 |
| | Ashless detergent-derived N atom content $N_C$ (ppm by mass) | | 1200 | 1200 | 1200 | 1500 | 900 | 1200 | 1500 | 900 |
| | Detergent-derived $N_C/Ca_B$ | | 2.4 | 2.4 | 2.4 | 3.0 | 1.8 | 2.4 | 3.0 | 1.8 |
| Evaluation | After water resistance test (62° C., water 3 wt %, 24 h + copper) | | | | | | | | | |
| Result | Base number after water resistance test (mgKOH/g) | | 4.78 | 4.79 | 5.68 | 6.78 | 4.63 | 5.98 | 7.09 | 4.94 |
| | Base number maintenance rate after water resistance test (%) | | 86.1 | 86.9 | 87.5 | 87.7 | 84.2 | 91.3 | 91.0 | 88.4 |
| | NOX test (140° C., NO 4000 ppm, 20 h) | | | | | | | | | |
| | Base number after heat resistance test (mgKOH/g) | | 3.85 | 3.72 | 4.61 | 6.11 | 3.99 | 3.74 | 4.72 | 2.91 |
| | Base number maintenance rate after heat resistance test (%) | | 69.4 | 67.5 | 71.0 | 79.0 | 72.5 | 57.1 | 60.6 | 52.1 |
| | HTT (240° C.) | | 8 | 8 | 8 | 6 | 8 | 8 | 8 | 8 |

TABLE 1-2

| | | | Ex. 9 | Ex. 10 | Ex. 11 |
|---|---|---|---|---|---|
| Lubricant Composition | Base oil (A) | | 80.84 | 80.84 | 80.84 |
| | Calcium-based detergent (B) | Ca sulfonate (1): base number: 18.1 mgKOH/g, linear structure | — | — | — |
| | | Ca sulfonate (2): base number: 11.3 mgKOH/g, branched structure | — | — | — |

TABLE 1-2-continued

| | | | Ex. 9 | Ex. 10 | Ex. 11 |
|---|---|---|---|---|---|
| | | Ca salicylate (1): base number: 59.8 mgKOH/g, branched structure | 2.16 | 2.16 | 2.16 |
| | | Ca salicylate (2): base number: 219 mgKOH/g, branched structure | — | — | — |
| | | Ca phenate (1): base number: 253 mgKOH/g, branched structure | — | — | — |
| | Calcium-based detergent (B') | Ca sulfonate (3): base number: 426 mgKOH/g, linear structure | — | — | — |
| | | Ca sulfonate (4): base number: 304 mgKOH/g, branched structure | — | — | — |
| | Ashless detergent (C) | Hindered amine compound (1): number of piperidine-derived backbones: 1 | 2.10 | 1.40 | 0.70 |
| | | Diethanolamine | 0.70 | 1.40 | 2.10 |
| | Ashless detergent (C') | Hindered amine compound (2): number of piperidine-derived backbones: 2 | — | — | — |
| | | Hindered amine compound (3): number of piperidine-derived backbones: 2 | — | — | — |
| | Zinc dialkyldithiophosphate | ZnDTP | 1.10 | 1.10 | 1.10 |
| | Organic molybdenum-based compound | MoDTC | 0.70 | 0.70 | 0.70 |
| | | MoDTP | — | — | — |
| | Antioxidant | Phenol-based antioxidant | 0.50 | 0.50 | 0.50 |
| | | Amine-based antioxidant | 1.00 | 1.00 | 1.00 |
| | Ashless dispersant | Non-borylated succinimide | 3.00 | 3.00 | 3.00 |
| | | Borylated succinimide | 2.00 | 2.00 | 2.00 |
| | Other additives for lubricant oil | | 5.90 | 5.90 | 5.90 |
| | Total | | 100 | 100 | 100 |
| | Initial base number (mgKOH/g) | | 6.74 | 6.73 | 6.74 |
| | Sulfate ash content (% by mass) | | 0.5 | 0.5 | 0.5 |
| | Ca atom content in lubricant composition (ppm by mass) | | 500 | 500 | 500 |
| | Calcium-based detergent-derived Ca content $Ca_B$ (ppm by mass) | | 500 | 500 | 500 |
| | $CaCO_3$-derived Ca content $Ca_{CaCO3}$ (ppm by mass) | | 170 | 170 | 170 |
| | N atom content in lubricant composition (ppm by mass) | | 2200 | 2200 | 2200 |
| | Ashless detergent-derived N atom content $N_C$ (ppm by mass) | | 1200 | 1200 | 1200 |
| | Detergent-derived $N/Ca_B$ | | 2.4 | 2.4 | 2.4 |
| Evaluation Result | After water resistance test (62° C., water 3 wt %, 24 h + copper) | | | | |
| | Base number after water resistance test (mgKOH/g) | | 5.89 | 6.02 | 6.20 |
| | Base number maintenance rate after water resistance test (%) | | 87.4 | 89.5 | 92.0 |
| | NOX test (140° C., NO 4000 ppm, 20 h) | | | | |
| | Base number after heat resistance test (mgKOH/g) | | 4.20 | 4.15 | 4.00 |
| | Base number maintenance rate after heat resistance test (%) | | 62.3 | 61.7 | 59.3 |
| | HTT (240° C.) | | 8 | 8 | 8 |

TABLE 1-3

| | | | Ex. 12 | Ex. 13 | Ex. 14 | Ex. 15 |
|---|---|---|---|---|---|---|
| Lubricant Composition | Base oil (A) | | 81.24 | 81.24 | 82.37 | 82.46 |
| | Calcium-based detergent (B) | Ca sulfonate (1): base number: 18.1 mgKOH/g, linear structure | — | — | — | — |
| | | Ca sulfonate (2): base number: 11.3 mgKOH/g, branched structure | — | — | — | — |
| | | Ca salicylate (1): base number: 59.8 mgKOH/g, branched structure | 2.16 | 2.16 | — | — |
| | | Ca salicylate (2): base number: 219 mgKOH/g, branched structure | — | — | 0.63 | — |
| | | Ca phenate (1): base number: 253 mgKOH/g, branched structure | — | — | — | 0.54 |
| | Calcium-based detergent (B) | Ca sulfonate (3): base number: 426 mgKOH/g, linear structure | — | — | — | — |
| | | Ca sulfonate (4): base number: 304 mgKOH/g, branched structure | — | — | — | — |
| | Ashless detergent (C) | Hindered amine compound (1): number of piperidine-derived backbones: 1 | 2.80 | 2.80 | 2.80 | 2.80 |
| | | Diethanolamine | — | — | — | — |
| | Ashless detergent (C') | Hindered amine compound (2): number of piperidine-derived backbones: 2 | — | — | — | — |
| | | Hindered amine compound (3): number of piperidine-derived backbones: 2 | — | — | — | — |
| | Zinc dialkyldithiophosphate | ZnDTP | 0.58 | 0.22 | 1.10 | 1.10 |
| | Organic molybdenum-based compound | MoDTC | — | — | 0.70 | 0.70 |
| | | MoDTP | 0.82 | 1.18 | — | — |

TABLE 1-3-continued

| | | | Ex. 12 | Ex. 13 | Ex. 14 | Ex. 15 |
|---|---|---|---|---|---|---|
| | Antioxidant | Phenol-based antioxidant | 0.30 | 0.50 | 0.50 | 0.50 |
| | | Amine-based antioxidant | 1.00 | 1.00 | 1.00 | 1.00 |
| | Ashless dispersant | Non-borylated succinimide | 3.00 | 3.00 | 3.00 | 3.00 |
| | | Borylated succinimide | 2.00 | 2.00 | 2.00 | 2.00 |
| | Other additives for lubricant oil | | 5.90 | 5.90 | 5.90 | 5.90 |
| | Total | | 100 | 100 | 100 | 100 |
| | Initial base number (mgKOH/g) | | 6.03 | 5.76 | 6.61 | 6.32 |
| | Sulfate ash content (% by mass) | | 0.5 | 0.5 | 0.5 | 0.5 |
| | Ca atom content in lubricant composition (ppm by mass) | | 500 | 500 | 500 | 500 |
| | Calcium-based detergent-derived Ca content $Ca_B$ (ppm by mass) | | 500 | 500 | 500 | 500 |
| | $CaCO_3$-derived Ca content $Ca_{CaCO3}$ (ppm by mass) | | 170 | 170 | 380 | 320 |
| | N atom content in lubricant composition (ppm by mass) | | 2000 | 2000 | 2100 | 2100 |
| | Ashless detergent-derived N atom content $N_C$ (ppm by mass) | | 1200 | 1200 | 1200 | 1200 |
| | Detergent-derived $N_C/Ca_B$ | | 2.4 | 2.4 | 2.4 | 2.4 |
| Evaluation | After water resistance test (62° C., water 3 wt %, 24 h + copper) | | | | | |
| Result | Base number after water resistance test (mgKOH/g) | | 5.04 | 4.78 | 5.42 | 5.36 |
| | Base number maintenance rate after water resistance test (%) | | 83.6 | 83.0 | 82.0 | 84.8 |
| | NOX test (140° C., NO 4000 ppm, 20 h) | | | | | |
| | Base number after heat resistance test (mgKOH/g) | | 4.07 | 3.64 | 4.51 | 4.81 |
| | Base number maintenance rate after heat resistance test (%) | | 67.5 | 63.2 | 68.2 | 76.1 |
| | HTT (240° C.) | | 8 | 8 | 8 | 8 |

TABLE 1-4

| | | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|---|
| Lubricant Composition | Base oil (A) | | 79.44 | 82.24 | 82.94 | 83.64 | 81.34 | 81.34 | 83.00 | 82.69 | 82.57 |
| | Calcium-based detergent (B) | Ca sulfonate (1): base number: 18.1 mgKOH/g, linear structure | — | — | — | — | — | — | — | — | — |
| | | Ca sulfonate (2): base number: 11.3 mgKOH/g, branched structure | — | — | — | — | — | — | — | — | — |
| | | Ca salicylate (1): base number: 59.8 mgKOH/g, branched structure | 2.16 | 2.16 | 2.16 | 2.16 | 2.16 | 2.16 | — | — | — |
| | | Ca salicylate (2): base number: 219 mgKOH/g, branched structure | — | — | — | — | — | — | — | — | — |
| | | Ca phenate (1): base number: 253 mgKOH/g, branched structure | — | — | — | — | — | — | — | — | — |
| | Calcium-based detergent (B) | Ca sulfonate (3): base number: 426 mgKOH/g, linear structure | — | — | — | — | — | — | — | 0.31 | — |
| | | Ca sulfonate (4): base number: 304 mgKOH/g, branched structure | — | — | — | — | — | — | — | — | 0.43 |
| | Ashless detergent (C) | Hindered amine compound (1): number of piperidine-derived backbones: 1 | 4.20 | 1.40 | 0.70 | — | — | — | 2.80 | 2.80 | 2.80 |
| | | Diethanolamine | — | — | — | — | — | — | — | — | — |
| | Ashless detergent (C') | Hindered amine compound (2): number of piperidine-derived backbones: 2 | — | — | — | — | 2.30 | — | — | — | — |

TABLE 1-4-continued

| | | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|---|
| | | Hindered amine compound (3): number of piperidine-derived backbones: 2 | — | — | — | — | — | 2.30 | — | — | — |
| | Zinc dialkyldithio-phosphate | ZnDTP | 1.10 | 1.10 | 1.10 | 1.10 | 1.10 | 1.10 | 1.10 | 1.10 | 1.10 |
| | Organic molybdenum-based compound | MoDTC | 0.70 | 0.70 | 0.70 | 0.70 | 0.70 | 0.70 | 0.70 | 0.70 | 0.70 |
| | | MoDTP | — | — | — | — | — | — | — | — | — |
| | Antioxidant | Phenol-based antioxidant | 0.50 | 0.50 | 0.50 | 0.50 | 0.50 | 0.50 | 0.50 | 0.50 | 0.50 |
| | | Amine-based antioxidant | 1.00 | 1.00 | 1.00 | 1.00 | 1.00 | 1.00 | 1.00 | 1.00 | 1.00 |
| | Ashless dispersant | Non-borylated succinimide | 3.00 | 3.00 | 3.00 | 3.00 | 3.00 | 3.00 | 3.00 | 3.00 | 3.00 |
| | | Borylated succinimide | 2.00 | 2.00 | 2.00 | 2.00 | 2.00 | 2.00 | 2.00 | 2.00 | 2.00 |
| | Other additives for lubricant oil | | 5.90 | 5.90 | 5.90 | 5.90 | 5.90 | 5.90 | 5.90 | 5.90 | 5.90 |
| | Total | | 100 | 100 | 100 | 100 | 100 | 100 | 100 | 100 | 100 |
| | Initial base number (mgKOH/g) | | 8.88 | 4.31 | 3.16 | 2.02 | 6.65 | 7.34 | 5.21 | 6.48 | 6.52 |
| | Sulfate ash content (% by mass) | | 0.5 | 0.5 | 0.5 | 0.5 | 0.5 | 0.5 | 0.3 | 0.5 | 0.5 |
| | Ca atom content in lubricant composition (ppm by mass) | | 500 | 500 | 500 | 500 | 500 | 500 | — | 500 | 500 |
| | Calcium-based detergent-derived Ca content $Ca_B$ (ppm by mass) | | 500 | 500 | 500 | 500 | 500 | 500 | — | 500 | 500 |
| | $CaCO_3$-derived Ca content $Ca_{CaCO3}$ (ppm by mass) | | 170 | 170 | 170 | 170 | 170 | 170 | | 170 | 170 |
| | N atom content in lubricant composition (ppm by mass) | | 2600 | 1600 | 1300 | 1000 | 2100 | 2100 | 2100 | 2100 | 2100 |
| | Ashless detergent-derived N atom content $N_C$ (ppm by mass) | | 1800 | 600 | 300 | | 1200 | 1200 | 1200 | 1200 | 1200 |
| | Detergent-derived $N_C/Ca_B$ | | 3.6 | 1.2 | 0.6 | | 2.4 | 2.4 | | 2.4 | 2.4 |
| Evaluation Result | After water resistance test (62° C., water 3 wt %, 24 h + copper) | | | | | | | | | | |
| | Base number after water resistance test (mgKOH/g) | | 7.60 | 3.59 | 2.51 | 1.65 | 3.97 | 6.25 | 5.11 | 5.38 | 5.40 |
| | Base number maintenance rate after water resistance test (%) | | 85.6 | 83.3 | 79.4 | 81.7 | 89.8 | 85.1 | 98.1 | 83.0 | 82.8 |
| | NOX test (140° C., NO 4000 ppm, 20 h) | | | | | | | | | | |
| | Base number after heat resistance test (mgKOH/g) | | 7.02 | 2.70 | 1.73 | 0.12 | 0.56 | 0.00 | 4.66 | 4.66 | 4.79 |
| | Base number maintenance rate after heat resistance test (%) | | 79.1 | 62.6 | 54.7 | 5.9 | 8.4 | 0.0 | 89.4 | 71.9 | 73.5 |
| | HTT (240° C.) | | 5 | 8 | 8 | 8 | 4 | 4 | 5 | 5 | 5 |

The followings can be found from the results noted in Table 1-1 to Table 1-4.

The lubricant compositions in Examples 1 to 15 are excellent in the initial base number, the base number maintainability after the water resistance test, the base number maintainability after the heat resistance test, and the high temperature cleanliness, and also are excellent in the long drainage property despite their low ash contents.

Meanwhile, when the ashless detergent (C) is contained, and the calcium-based detergent (B) is not contained as in the lubricant composition of Comparative Example 7, the high temperature cleanliness is poor, and the long drainage property cannot be secured.

In addition, when Ca sulfonate having a base number of greater than 100 mgKOH/g was used as in the lubricant compositions of Comparative Examples 8 and 9, even if the ashless detergent (C) is used in combination, the high temperature cleanliness is poor, and the long drainage property cannot be secured.

When $N_C/Ca_B$ derived from the detergents is greater than 3.1 as in the lubricant composition in Comparative Example 1, the high temperature cleanliness is poor, and the long drainage property cannot be secured.

When $N_C/Ca_B$ derived from the detergents is less than 1.3 as in the lubricant compositions in Comparative Examples 2 and 3, the initial base number cannot be sufficiently increased, and thus the long drainage property cannot be secured. In addition, when the calcium-based detergent (B) is contained, and the ashless detergent (C) is not contained as in the lubricant composition of Comparative Example 4, the initial base number cannot be sufficiently increased, and thus the long drainage property cannot be secured.

When a hindered amine compound having two or more piperidine-derived backbones is used as the ashless detergent as in the lubricant compositions in Comparative Examples 5 and 6, the high temperature cleanliness is poor, the base number maintenance rate after the heat resistance test is low and the base number maintainability is poor, and thus the long drainage property cannot be secured.

The invention claimed is:

1. A lubricant composition, comprising:

a base oil (A);

a calcium-based detergent (B) selected from the group consisting of (B1) calcium sulfonate having a base number in a range of from 5.00 to 100 mgKOH/g, (B2) calcium salicylate comprising a branched acyclic hydrocarbon group and having a base number in a range of from 5.00 to 600 mgKOH/g, and (B3) overbased calcium phenate comprising a branched acyclic hydrocarbon group and having a base number in a range of from 200 to 450 mgKOH/g; and an ashless detergent (C) selected from the group consisting of (C1) a hindered amine compound comprising one piperidine-derived backbone in a molecule, and (C2) a diethanolamine compound of formula (1)

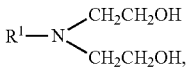

(1)

wherein $R^1$ is a monovalent aliphatic hydrocarbon group comprising 12 to 30 carbon atoms, wherein a calcium atom content is in a range of from 100 to 600 ppm by mass with respect to total lubricant composition mass, wherein an $N_C/Ca_B$ mass ratio of a nitrogen atom content ($N_C$) of the ashless detergent (C) to a calcium atom content ($Ca_B$) of the calcium-based detergent (B) is in a range of from 1.3 to 2.4, and wherein the lubricant composition comprises molybdenum dithiocarbamate, but does not comprise molybdenum dithiophosphate.

2. The composition of claim 1, wherein the calcium-based detergent (B) comprises the calcium salicylate (B2).

3. The composition of claim 1, wherein a calcium atom content ($Ca_{CaCO3}$) of calcium carbonate derived from the calcium-based detergent (B) is 400 ppm by mass or less with respect to the total lubricant composition mass.

4. The composition of claim 1, wherein the nitrogen atom content ($N_C$) of the ashless detergent (C) is in a range of from 100 to 1,700 ppm by mass with respect to the total lubricant composition mass.

5. The composition of claim 1, wherein a sulfate ash content of the lubricant composition is 0.60% by mass or less.

6. The composition of claim 1, wherein an initial base number of the lubricant composition is 5.00 mgKOH/g or more.

7. The lubricant composition of claim 1, which is adapted for an internal combustion engine.

8. The lubricant composition of claim 1, which is adapted for a turbo mechanism-equipped engine.

9. The lubricant composition of claim 1, which is adapted for a gasoline engine or a diesel engine equipped with a particulate filter.

10. A method of producing the lubricant composition of claim 1, the method comprising:

combining components comprising the base oil (A);

the calcium-based detergent (B); and the ashless detergent (C), wherein the combining is carried out to satisfy (1) and (2):

(1): a calcium atom content is in a range of from 100 to 600 ppm by mass with respect to the total lubricant composition mass, and (2): a mass ratio ($N_C/Ca_B$) of a nitrogen atom content ($N_C$) of the ashless detergent (C) to a calcium atom content ($Ca_B$) of the calcium-based detergent (B) is in a range of from 1.3 to 2.4.

11. The composition of claim 1, comprising no further detergent than the calcium-based detergent (B) and the ashless detergent (C).

12. The composition of claim 1, wherein the calcium-based detergent (B) comprises the calcium sulfonate (B1).

13. The composition of claim 1, wherein the calcium-based detergent (B) comprises the overbased calcium phenate (B3).

14. The composition of claim 1, wherein the ashless detergent (C) comprises the hindered amine compound (C1).

15. The composition of claim 1, wherein the ashless detergent (C) comprises the diethanolamine compound (C2).

16. The composition of claim 1, wherein the ashless detergent (C) comprises the hindered amine compound (C1) and the diethanolamine compound (C2).

17. The composition of claim 1, wherein the $N_C/Ca_B$ mass ratio is in a range of from 1.8 to 2.4.

18. The composition of claim 1, wherein, based on total lubricant composition mass, the base oil (A) is present in a range of from 60 to 90% by mass, the calcium-based detergent (B) is present in a range of from 0.100 to 3.00% by mass, and the ashless detergent (C) is present in a range of from 1.00 to 5.00% by mass.

* * * * *